US008526834B2

(12) United States Patent
Kawai

(10) Patent No.: US 8,526,834 B2
(45) Date of Patent: Sep. 3, 2013

(54) IMAGE FORMING APPARATUS, REPLACEMENT TONER CARTRIDGE MANAGEMENT APPARATUS, REPLACEMENT TONER CARTRIDGE MANAGEMENT SYSTEM, REPLACEMENT TONER CARTRIDGE MANAGEMENT METHOD, AND RECORDING MEDIUM

(75) Inventor: Atsushi Kawai, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 218 days.

(21) Appl. No.: 13/189,840

(22) Filed: Jul. 25, 2011

(65) Prior Publication Data

US 2012/0027423 A1 Feb. 2, 2012

(30) Foreign Application Priority Data

Jul. 28, 2010 (JP) ..... 2010-169875

(51) Int. Cl.
*G03G 15/00* (2006.01)
*G03G 15/08* (2006.01)
*G03G 15/20* (2006.01)

(52) U.S. Cl.
USPC ..... 399/12; 399/8

(58) Field of Classification Search
USPC ..... 399/8, 12, 27, 69
See application file for complete search history.

(56) References Cited

U.S. PATENT DOCUMENTS 6,246,843 B1 6/2001 Nanataki et al.
6,798,995 B2 9/2004 Nagata
7,313,339 B2 12/2007 Nishiyama (Continued)

FOREIGN PATENT DOCUMENTS

JP H09-015925 A 1/1997
JP 10-186938 A 7/1998

(Continued)

OTHER PUBLICATIONS

Decision to Grant Patent Issued by the Japanese Patent Office in Japanese Application No. 2010-169875 mailed on Dec. 4, 2012, and English translation (6 pages).

(Continued)

*Primary Examiner* — David Gray
*Assistant Examiner* — Michael Harrison
(74) *Attorney, Agent, or Firm* — Buchanan Ingersoll & Rodney PC

(57) ABSTRACT

An image forming apparatus is provided with: an obtainer which obtains first information indicating a new toner cartridge having just been loaded thereon or a toner cartridge to be replaced with a new one and second information indicating the current condition under which a fusing process is performed for image forming; a determiner which determines the right type of a replacement toner cartridge to be loaded in place of the toner cartridge causing the first information obtained by the obtainer, based on the second information also obtained by the obtainer; an output portion which outputs an instruction to deliver a replacement toner cartridge of the type determined by the determiner; a detector which detects a new toner cartridge having just been loaded thereon; and a fusing processor which performs a fusing process under the optimal condition based on the amount of the toner supplied from the detector's detected new toner cartridge which is a replacement toner cartridge delivered according to the delivery instruction outputted by the output portion.

19 Claims, 16 Drawing Sheets

(56) References Cited

U.S. PATENT DOCUMENTS

| | | | | |
|---|---|---|---|---|
| 8,050,977 | B2 | 11/2011 | Kawai | |
| 8,203,737 | B2 * | 6/2012 | Condello et al. | 358/1.15 |
| 2002/0159777 | A1 * | 10/2002 | Nagata | 399/8 |
| 2009/0174888 | A1 * | 7/2009 | Ko | 358/1.9 |

FOREIGN PATENT DOCUMENTS

| | | | |
|---|---|---|---|
| JP | 2001-043965 | A | 2/2001 |
| JP | 2001-296786 | A | 10/2001 |
| JP | 2002-297969 | A | 10/2002 |
| JP | 2006-010783 | A | 1/2006 |
| JP | 2006-133250 | A | 5/2006 |
| JP | 2008-271231 | A | 11/2006 |
| JP | 2007-148254 | A | 6/2007 |
| JP | 2007-199361 | A | 8/2007 |
| JP | 2007-304186 | A | 11/2007 |
| JP | 2009-003674 | A | 1/2009 |

OTHER PUBLICATIONS

Office Action (Notification of Reasons for Refusal) dated May 22, 2012, issued in corresponding Japanese Patent Application No. 2010-169875, and an English translation thereof. (4 pages).

* cited by examiner

| | | | | Controlled Power (W) |
|---|---|---|---|---|
| The Difference between the Actual Fuser Temperature and the Optimal (Target) Fuser Temperature | | ~< | | 600 |
| | −10 | ≦~< | −9 | 600 |
| | −9 | ≦~< | −8 | 480 |
| | −8 | ≦~< | −7 | 340 |
| | −7 | ≦~< | −6 | 260 |
| | −6 | ≦~< | −5 | 240 |
| | −5 | ≦~< | −4 | 220 |
| | −4 | ≦~< | −3 | 200 |
| | −3 | ≦~< | −2 | 200 |
| | −2 | ≦~< | −1 | 200 |
| | −1 | ≦~< | 0 | 200 |
| | 0 | ≦~< | 1 | 200 |
| | 1 | ≦~< | 2 | 200 |
| | 2 | ≦~< | 3 | 180 |
| | 3 | ≦~< | 4 | 180 |
| | 4 | ≦~< | 5 | 160 |
| | 5 | ≦~< | 6 | 140 |
| | 6 | ≦~< | 7 | 140 |
| | 7 | ≦~< | 8 | 100 |
| | 8 | ≦~< | 9 | 40 |
| | 9 | ≦~< | 10 | 0 |
| | 10 | ≦~ | | OFF |

FIG.8

| Color Mode | The AD Value on the Current Monitor of the 24V Power Supply (averaged) | The Amount of IH Power to be Reduced (W) |
|---|---|---|
| Monochrome | 0 ≦AD Value< 400 | 0 |
| | 400 ≦AD Value< 450 | 60 |
| | 450 ≦AD Value≦ 1023 | 90 |
| Color | 0 ≦AD Value≦ 520 | 0 |
| | 520 ≦AD Value≦ 580 | 60 |
| | 580 ≦AD Value≦ 1023 | 90 |

FIG.9

| Fuser Temperature | Optimal Level of Productivity |
|---|---|
| Actual Fuser Temperature≧Optimal (Target) Fuser Temperature −5°C | Normal Operation |
| Optimal (Target) Fuser Temperature −5°C>Actual Fuser Temperature≧Optimal (Target) Fuser Temperature −25°C | 80% |
| Optimal (Target) Fuser Temperature −25°C>Actual Fuser Temperature≧Optimal (Target) Fuser Temperature −35°C | 60% |
| Optimal (Target) Fuser Temperature −35°C>Actual Fuser Temperature | Operation Stop |

FIG.10

Display the following messages depending on remaining toner information:

①Normal:
(No message displayed)
②Toner Near Empty:
"There will be a need for toner cartridge replacement in a short time."
③Toner Empty(permit printing):
"The toner cartridge is running out of toner. Please replace."
(Printing is available when receiving the information 1,2 or 3)

Toner Empty(prohibit printing):
"The toner cartridge has run out of toner. Please immediately replace."(Strong alert message)(Printing is not available when receiving this information)

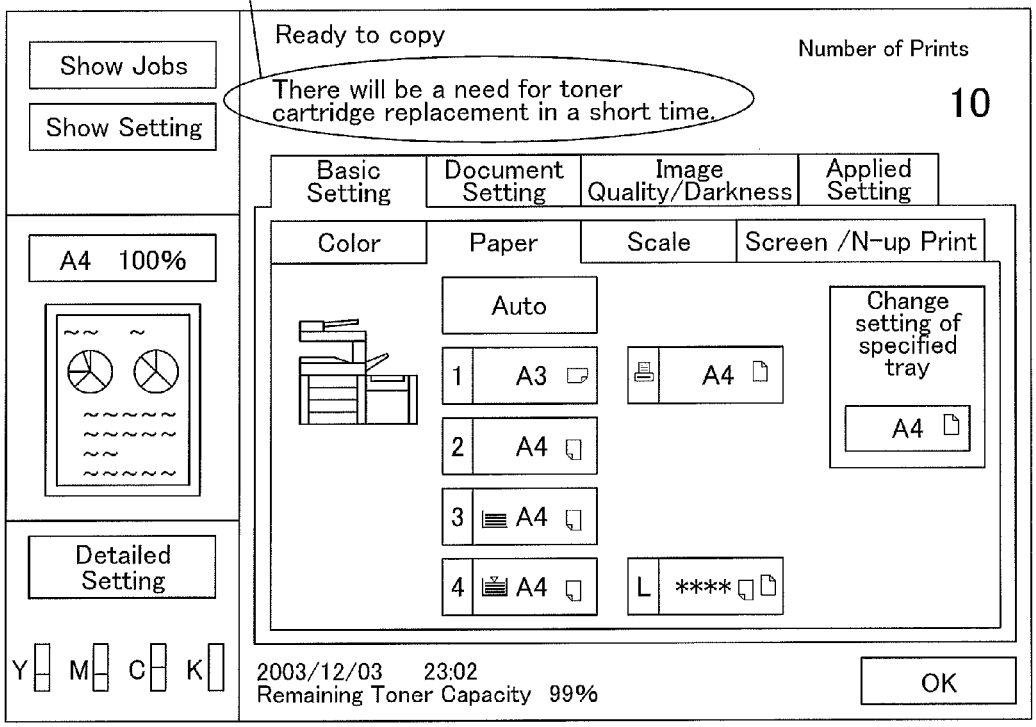

FIG.14

| Remaining Toner Information | Permit/ Prohibit Printing | Panel Display | Toner State |
|---|---|---|---|
| Normal | Permit printing | (No message displayed) | The sub-hopper and the toner cartridge hold enough toner. |
| Toner Near Empty | Permit printing | One-line message: "There will be a need for toner cartridge replacement in a short time." | The sub-hopper holds some toner but the toner cartridge nearly runs out of toner. |
| Toner Empty (permit printing) | Permit printing | One-line message: "The toner cartridge is running out of toner. Please replace." | The sub-hopper holds some toner but the toner cartridge absolutely runs out of toner. |
| Toner Empty (prohibit printing) | Prohibit printing | Strong Alert message: "The toner cartridge has run out of toner. Please immediately replace and close the toner garage door." | The sub-hopper and the toner cartridge absolutely run out of toner, and printing is not available any more due to low toner concentration. |

FIG.15

Using ordinary toner after low-melting-point toner

| The cumulative amount of the ordinary toner supplied | Optimal Fuser Temperature |
|---|---|
| 0g<The amount of the toner≦50g | 140℃ |
| 50g<The amount of the toner≦100g | 145℃ |
| 100g<The amount of the toner≦150g | 155℃ |
| 150g<The amount of the toner | 160℃ |

FIG.21A

Using low-melting-point toner after ordinary toner

| The cumulative amount of the low-melting-point toner supplied | Optimal Fuser Temperature |
|---|---|
| 0g<The amount of the toner≦50g | 160℃ |
| 50g<The amount of the toner≦100g | 155℃ |
| 100g<The amount of the toner≦150g | 145℃ |
| 150g<The amount of the toner | 140℃ |

FIG.21B

IMAGE FORMING APPARATUS, REPLACEMENT TONER CARTRIDGE MANAGEMENT APPARATUS, REPLACEMENT TONER CARTRIDGE MANAGEMENT SYSTEM, REPLACEMENT TONER CARTRIDGE MANAGEMENT METHOD, AND RECORDING MEDIUM

This application claims priority under 35 U.S.C. §119 to Japanese Patent Application No. 2010-169875 filed on Jul. 28, 2010, the entire disclosure of which is incorporated herein by reference in its entirety.

BACKGROUND OF THE INVENTION

1. Field of the Invention

The present invention relates to an image forming apparatus, a replacement toner cartridge management apparatus, and a replacement toner cartridge management system which manage replacement toner cartridges to be loaded in place of toner cartridges loaded on an image forming apparatus; a replacement toner cartridge management method; a recording medium having a fuser control program stored thereon to make a computer of the image forming apparatus execute processing; and a recording medium having a replacement toner cartridge management program stored thereon to make a computer of the replacement toner cartridge management apparatus implement the replacement toner cartridge management method.

2. Description of the Related Art

The following description sets forth the inventor's knowledge of related art and problems therein and should not be construed as an admission of knowledge in the prior art.

Conventionally, if the remaining consumable resource in a consumable unit loaded on an image forming apparatus such as an electrophotographic copier, an electrophotographic printer, or an electrophotographic multifunctional machine called MFP (Multi Function Peripheral), for example, the amount of remaining toner in a toner cartridge is lower than a predetermined level, the image forming apparatus determines that the toner cartridge will run out of toner in a short time (the toner cartridge is nearly empty) and displays a message stating that the toner cartridge is nearly empty on a display panel provided thereon so that the user can notice it. Noticing this message, the user prepares a replacement toner cartridge, or places an order for a replacement toner cartridge if not having it in stock.

Meanwhile, in recent years, an image forming apparatus which is connected with a management apparatus to exchange information with has been more commonly used in a remote management system (for example, Japanese Unexamined Patent Publication No. 2002-297969). In many cases, a retailer of image forming apparatuses or a provider of office supplies have their own management apparatus in their own place, in order to collect, store, and manage for their business, various types of information including toner near empty information from a plurality of image forming apparatuses in their users' places. Being connected with the image forming apparatuses, the management apparatus is capable of recognizing a nearly empty toner cartridge or a new toner cartridge.

In some cases, the management apparatus is further connected with an order receiving apparatus receiving orders for a replacement toner cartridge (for example, Japanese Unexamined Patent Publication No. 2008-271231). In such a case, the management apparatus further transmits an order to the order receiving apparatus, so that a replacement toner cartridge will be delivered to the user. In other words, this is exactly a system to automatically deliver replacement toner cartridges to users while they need not bother to place an order for them.

As for a fuser which fuses toner to a sheet of paper or the like, the induction heating method (IH method) has drawn considerable attention for its capability of rapid heating and highly-efficient heating, receiving requirements for reducing the time required for warm-up and energy consumption. To explain an ordinary fuser using the induction heating method, a fuser portion (such as a roller or a belt) heated by an electromagnetic induction coil and a pressure portion (such as a roller) are pressed against each other and a nip area is created between these portions. And a sheet of paper carrying toner thereon goes through the nip area to have the toner fused and firmly fixed thereon.

Such an ordinary fuser using the induction heating method is provided with a resonance circuit consisting of an inductive coil and a capacitor connected to each other (for example, Japanese Laid-open Patent Publication No. 2001-043965). And the alternating-current power of one frequency from a commercial power supply is converted into the alternating-current power of another frequency by an inverter circuit, then is applied to the resonance circuit. By exciting the inductive coil in this way, the hot portion is heated.

An image forming apparatus employing such an induction heating (IH) fusing method performs the fuser temperature control by controlling the power input to an induction heating (IH) fuser heater. The power input to the IH fuser heater is reduced depending on the use of the user operating the image forming apparatus. When the image forming apparatus operates at high speed with power from one outlet, the power input to the IH fuser heater is sometimes reduced because the maximum input power is limited to 15 A according to the regulation in Japan.

The following are the cases in which the power input to the IH fuser heater is restricted and enough power for the fusing process cannot be reached.

[1] The fuser can be hardly heated under the circumstances with low temperature and low humidity.

[2] A particular type of paper which takes much amount of heat from the fuser is used for making copies or many copies are made with a high ratio of B (black) to W (white).

[3] The fuser, not yet heated enough is used for the first time for the day, for continuously making copies.

[4] A plurality of options requiring rather much power (finisher, ADF, and the like) are installed on the image forming apparatus, and some of them are running at the same time. (For example, while sheets of paper are continuously read by the ADF, the printed sheets are stapled by the finisher).

When the power input to the fuser is reduced in the cases as described above, an amount of heat high enough to fuse toner to a sheet of paper is not obtained, and thus a permanent image cannot be perfectly created thereon because of bad fusing. To prevent such a possible trouble, conventionally, the interval between sheets of paper is set longer than normal or the print operation is temporarily stopped, by quality keeping control. However, such a solution involving the control operation may cause another trouble; the productivity of printing may decrease to lower than a standard level, which is penalizing users.

On the other hand, for recent years, low-melting-point toner requiring a fuser temperature much lower than the conventional type of toner has been developed and just been started to be applied to practical use. Requiring a lower fuser temperature, the low-melting-point toner can contribute to the image forming apparatus's reducing the time required for warm-up and energy consumption. The low-melting-point toner also may contribute to reducing the frequency of or eliminating the reduction of the input power. However, having not yet been commonly used, the low-melting-point toner still costs more than the ordinary toner.

Furthermore, when the power input to the IH fuser heater is reduced, the productivity of printing easily or hardly decreases depending on the user, i.e. the use, printing conditions, and the location of the image forming apparatus as described above. Users who rarely encounter the case of the decrease in productivity due to the reduction of the input power would not need to use the low-melting-point toner because a permanent image can be perfectly created even with the ordinary toner.

Therefore, it would be better to select either the ordinary toner or the low-melting-point toner depending on the use of the user operating the image forming apparatus.

Using multiple types of toner cartridges, the image forming apparatus needs to identify them to perform the fuser temperature control accordingly.

Furthermore, there is an idea of loading an information recording medium such as a memory chip on a toner cartridge; writing information such as a type of toner contained in the toner cartridge on the memory chip; then adding to the body of the image forming apparatus a feature to access the memory chip, in order to allow the image forming apparatus to perform control perfectly with a consideration of the characteristics of toner by reading out data from the memory chip. To the contrary, more types of toner cartridges recently do not have a memory chip inside for the saving on the costs of toner cartridges. Therefore, another method of identifying the type of the toner in a toner cartridge based on the toner characteristics is required.

Meanwhile, if the image forming apparatus uses multiple types of toner, the following are possible troubles.

[1] A Toner Cartridge Containing a Certain Type of Toner is Replaced with a New One Containing a Different Type of Toner Since different types of toner with different characteristics (which require different optimal fuser temperatures) are mixed in a development unit, and the optimal fuser temperature is changed depending on, the ratio of the ordinary toner to the low-melting-point toner in the development unit.

[2] Different Colors and Types of Toner are Contained in the Toner Cartridges in a Color Image Forming Apparatus When some of the toner cartridges uses the ordinary toner while the other ones uses the low-melting-point toner, the optimal fuser temperature is changed depending on the proportion of the colors of the toner transferred to paper.

[3] The Case [1] Combined with the Case [2]

In this case, the trouble is more complicated.

As described above, it is effective to use multiple types of toner and perform the fuser temperature control, which still leaves some troubles unresolved.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

According to a first aspect of the present invention, an image forming apparatus is provided with:

an obtainer which obtains first information indicating a new toner cartridge having just been loaded thereon or a toner cartridge to be replaced with a new one and second information indicating the current condition under which a fusing process is performed for image forming;

a determiner which determines the right type of a replacement toner cartridge to be loaded in place of the toner cartridge causing the first information obtained by the obtainer, based on the second information also obtained by the obtainer;

an output portion which outputs an instruction to deliver a replacement toner cartridge of the type determined by the determiner;

a detector which detects a new toner cartridge having just been loaded thereon; and a fusing processor which performs a fusing process under the optimal condition based on the amount of the toner supplied from the detector's detected new toner cartridge which is a replacement toner cartridge delivered according to the delivery instruction outputted by the output portion.

According to a second aspect of the present invention, a replacement toner cartridge management apparatus is provided with:

an obtainer which obtains from one or more than one image forming apparatus which the replacement toner cartridge management apparatus can access via a communication circuit, first information indicating a new toner cartridge having just been loaded thereon or a toner cartridge to be replaced with a new one and second information indicating the current condition under which a fusing process is performed for image forming;

a determiner which determines the right type of a replacement toner cartridge to be loaded in place of the toner cartridge causing the first information obtained by the obtainer, based on the second information also obtained by the obtainer;

an output portion which outputs an instruction to deliver a replacement toner cartridge of the type determined by the determiner; and a transmitter which transmits information indicating that delivery has been arranged, to the image forming apparatus, so that the image forming apparatus can perform a fusing process under the optimal condition based on the amount of the toner supplied from a replacement toner cartridge delivered according to the delivery instruction outputted by the output portion.

According to a third aspect of the present invention, a replacement toner cartridge management system is provided with one or more than one image forming apparatus and a management apparatus which can access each other via a communication circuit, wherein:

the image forming apparatus is provided with:

a transmitter which transmits first information indicating a new toner cartridge having just been loaded thereon or a toner cartridge to be replaced with a new one and second information indicating the current condition under which a fusing process is performed for image forming;

the management apparatus is provided with:

an obtainer which obtains the first information and the second information;

a determiner which determines the right type of a replacement toner cartridge to be loaded in place of the toner cartridge causing the first information obtained by the obtainer, based on the second information also obtained by the obtainer;

an output portion which outputs an instruction to deliver a replacement toner cartridge of the type determined by the determiner; and a transmitter which transmits information indicating that delivery has been arranged, to the image forming apparatus; and the image forming apparatus is further provided with:

a detector which detects a new toner cartridge having just been loaded thereon; and an identification portion which identifies the type of a replacement toner cartridge delivered, from the information received from the transmitter of the management apparatus; and a fusing processor which performs a fusing process under the optimal condition based on the amount of the toner supplied from the detector's detected new toner cartridge which is a replacement toner cartridge delivered according to the delivery instruction outputted by the output portion of the management apparatus.

According to a fourth aspect of the present invention, a non-transitory computer-readable recording medium has a fuser control program stored thereon to make a computer of an image forming apparatus execute:

obtaining first information indicating a new toner cartridge having just been loaded on the image forming apparatus or a toner cartridge to be replaced with a new one and second information indicating the current condition under which a fusing process is performed for image forming;

determining the right type of a replacement toner cartridge to be loaded in place of the toner cartridge causing the obtained first information, based on the obtained second information;

outputting an instruction to deliver a replacement toner cartridge of the determined type;

detecting a new toner cartridge having just been loaded thereon; and performing a fusing process under the optimal condition based on the amount of the toner supplied from the detected new toner cartridge which is a replacement toner cartridge delivered according to the delivery instruction.

According to a fifth aspect of the present invention, a replacement toner cartridge management method for a replacement toner cartridge management system provided with one or more than one image forming apparatus and a management apparatus which can access each other via a communication circuit, includes:

the image forming apparatus's:

transmitting first information indicating a new toner cartridge having just been loaded thereon or a toner cartridge to be replaced with a new one and second information indicating the current condition under which a fusing process is performed for image forming; the management apparatus's:

obtaining the first information and the second information;

determining the right type of a replacement toner cartridge to be loaded in place of the toner cartridge causing the obtained first information, based on the obtained second information;

outputting an instruction to deliver a replacement toner cartridge of the determined type; and transmitting information indicating that delivery has been arranged, to the image forming apparatus; and the image forming apparatus's:

detecting a new toner cartridge having just been loaded thereon;

identifying the type of a replacement toner cartridge delivered, from the information received from the management apparatus; and performing a fusing process under the optimal condition based on the amount of the toner supplied from the detected new toner cartridge which is a replacement toner cartridge delivered according to the delivery instruction.

According to a sixth aspect of the present invention, a non-transitory computer-readable recording medium has a replacement toner cartridge management program stored thereon to make a computer of a replacement toner cartridge management apparatus execute:

obtaining from one or more than one image forming apparatus which the management apparatus can access via a communication circuit, first information indicating a new toner cartridge having just been loaded on the image forming apparatus or a toner cartridge to be replaced with a new one and second information indicating the current condition under which a fusing process is performed for image forming;

determining the right type of a replacement toner cartridge to be loaded in place of the toner cartridge causing the obtained first information, based on the obtained second information;

outputting an instruction to deliver a replacement toner cartridge of the determined type; and transmitting information indicating that delivery has been arranged, so that the image forming apparatus can perform a fusing process under the optimal condition based on the amount of the toner supplied from a replacement toner cartridge delivered according to the delivery instruction.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 8 is a table illustrating the controlled power necessary to eliminate the difference between the fuser temperature actually sensed by the fuser temperature sensor and the optimal (target) fuser temperature;

FIG. 9 is a table illustrating the amount of IH (Induction Heating) power to be reduced based on the AD value on the current monitor of the 24V power supply;

FIG. 10 is a table illustrating the optimal level of productivity based on the optimal (target) fuser temperature;

FIG. 14 is a view to explain an example of an alert message displayed on an operation panel of the image forming apparatus;

FIG. 15 is a table illustrating the statuses depending on remaining toner level;

FIG. 17 is a flowchart representing a processing routine to count how many times the productivity has been decreased, to determine the right type of replacement toner cartridge based on;

FIG. 21 is a table illustrating the optimal (target) fuser temperature depending on the cumulative amount of toner fed from a new toner cartridge.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, one mode of implementing the present invention will be described with reference to the accompanying drawings.

Figure 1:
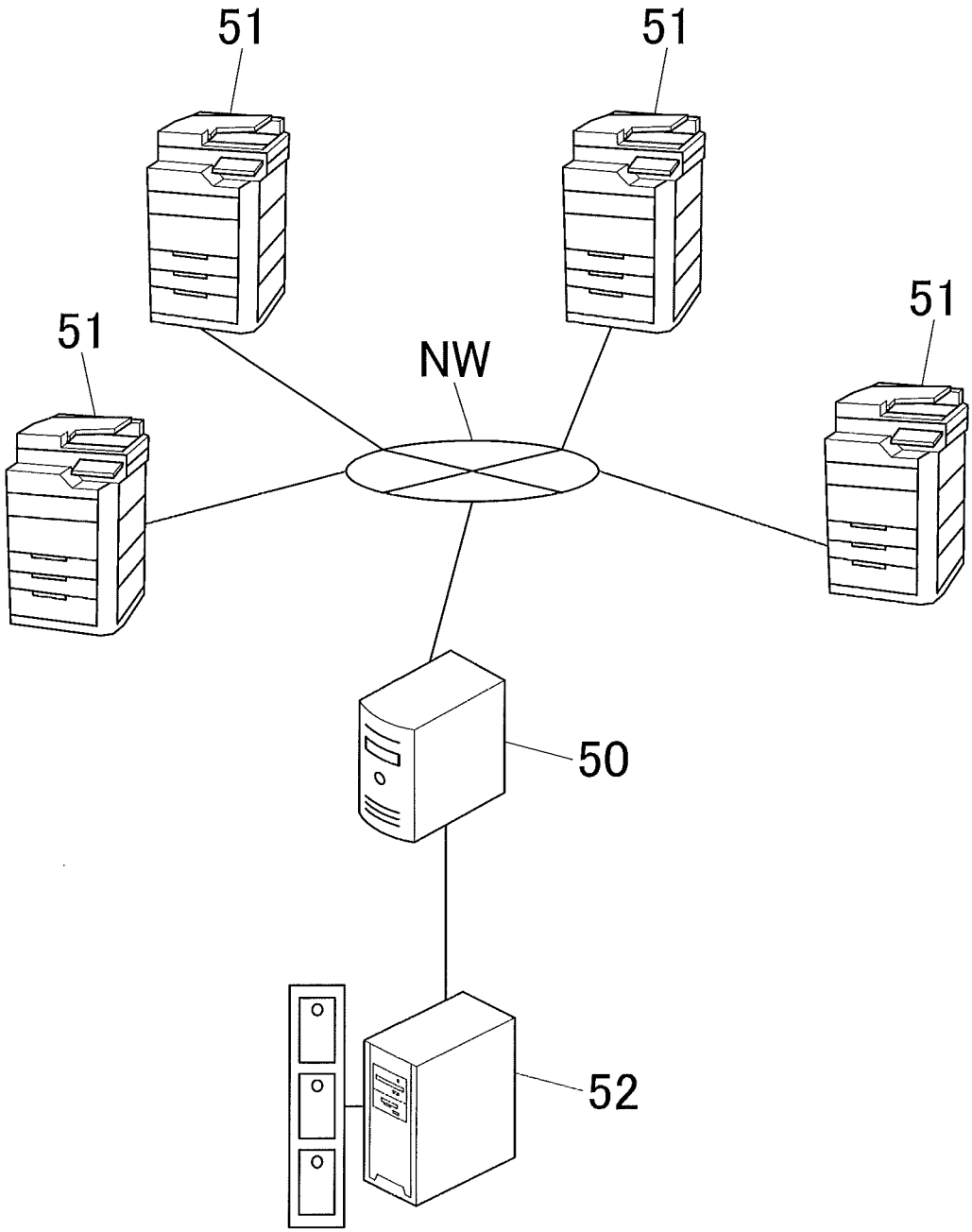
FIG. 1 is a view illustrating a configuration of a replacement toner cartridge management system according to one mode of implementing the present invention.

FIG. 1 is a view schematically illustrating a configuration of a replacement toner cartridge management system according to one mode of implementing the present invention.

As illustrated in FIG. 1, this management system is basically provided with one or more than one image forming apparatus 51 and a management server 50, which are connected to each other via a communication circuit such as Internet. The management server 50 is further connected to an order receiving server 52 via the Internet or the like.

The management server 50 is ordinarily provided in a service center or the like taking care of the image forming apparatuses 51 to manage information of the image forming apparatuses 51 by user accounts. More specifically, by communicating with the image forming apparatuses 51, the management server 50 monitors the remaining toner level(s) of a single toner cartridge containing one color toner or multiple toner cartridges containing different color toner that is a consumable resource, loaded on the image forming apparatuses 51, and also monitors if there is a replacement toner cartridge (s) for the toner cartridge(s) in stock. The image management server 50 further manages billing transactions and maintenance issues by collecting billing information such as number of prints and trouble information from the image forming apparatuses 51.

Users may use different types of image forming apparatuses; the image forming apparatuses 51 may be of different types. For example, the image forming apparatuses 51 may be printers, full-color copiers, monochrome copiers, and the like. Therefore, the image forming apparatuses 51 may load four toner cartridges containing the four color toner: yellow (Y), magenta (M), cyan (C), and black (K), or only one toner cartridge containing the one color toner, black (K).

Furthermore, by monitoring unique uses and use patterns of the users, the management server 50 remotely controls the image forming apparatuses 51 for perfect performance based on settings and the like of the image forming apparatuses 51 stored on its own recording medium. The setting information of the image forming apparatuses 51 is integrally managed by the management server 50; it therefore can be changed by the management server 50 quite easily even if some of the image forming apparatuses 51 are located in remote areas.

The image forming apparatuses 51 and the management server 50 exchange information with each other, for example by e-mails via the Internet network.

Being connected to the order receiving server 52 as described above, the management server 50 can output a delivery instruction to the order receiving server 52, based on toner cartridge replacement information from an image forming apparatus 51, which indicates a toner cartridge has been replaced with a new one, or a notice such as toner near empty information, which indicates that the remaining amount of toner reaches a predetermined value, so that the order receiving server 52 will arrange for the delivery and the user will receive a replacement toner cartridge automatically delivered without the need for placing an order for it.

Figure 2:
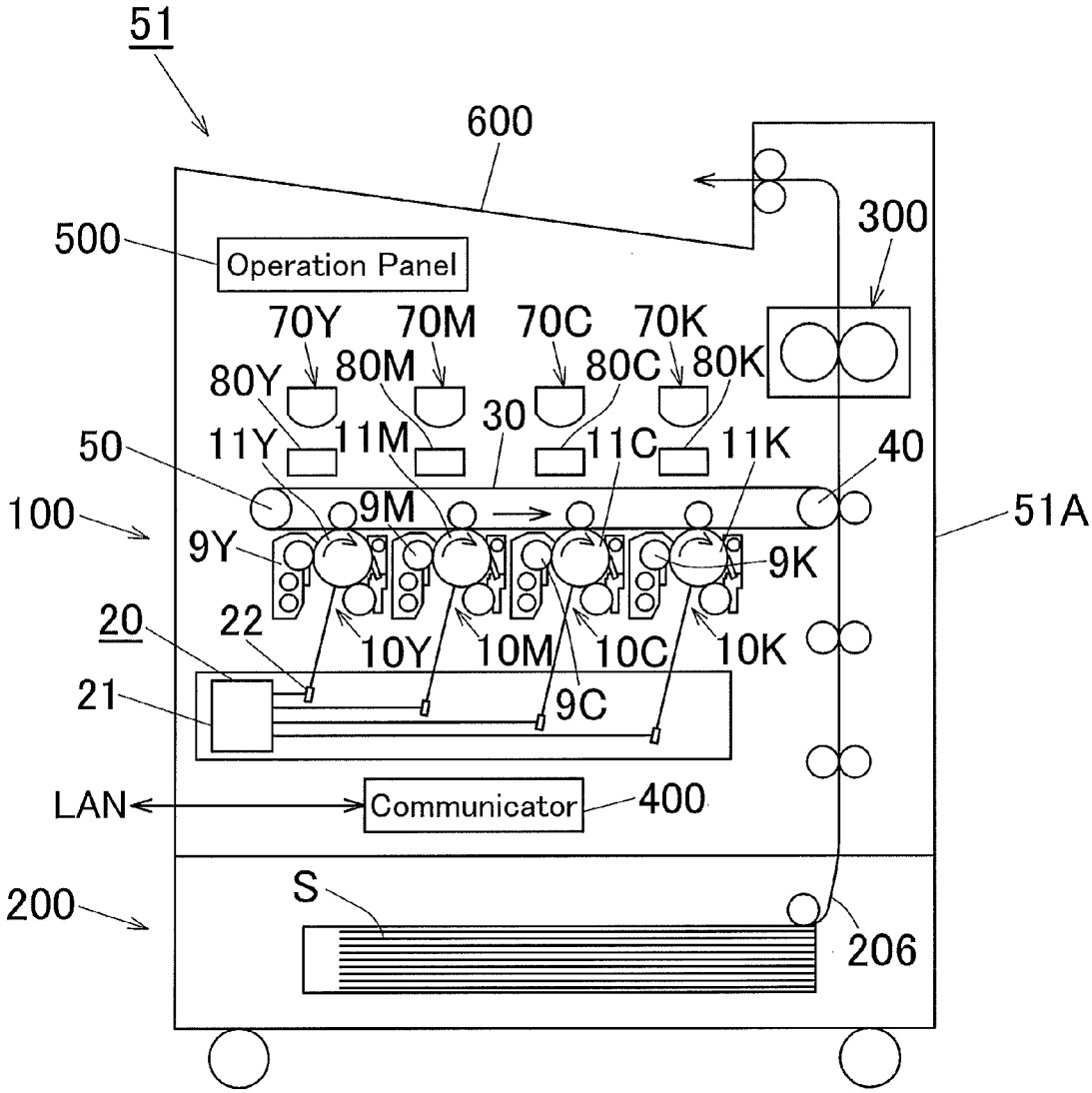
FIG. 2 is a view schematically illustrating a configuration of an image forming apparatus employed in the replacement toner cartridge management system of FIG. 1.

FIG. 2 is a view schematically illustrating a configuration of an image forming apparatus 51. In this example, a tandem color printer is employed as the image forming apparatus 51.

As illustrated in FIG. 1, the image forming apparatus 51 has a paper feeder 200 in the lower area of the body 51A, a color image former 100 in the middle area of the body 51A, and a paper discharger 600 in the upper area of the body 51A, respectively. A paper conveyance path 206 conveying toward the upper area, paper (a sheet of paper) S provided by the paper feeder 200 is extended all the way from the paper feeder 200 to the paper discharger 600.

The color image former 100 includes: a driving roller 40 and a driven roller 50 provided in the middle area of the vertical direction of the body 51A; a midway transfer belt 30 horizontally going around a group of the driving roller 40 and the driven roller 50 to run toward the direction indicated by arrow; and image forming units 10Y, 10M, 10C, and 10K containing yellow (Y), magenta (M), cyan (C), and black (K) toner, respectively, provided along the belt's running direction.

Toner images formed by the image forming units 10Y, 10M, 10C, and 10K are layered together and transferred onto the transfer belt 30. In the second transfer process, the merged toner images are further transferred on the paper S passing through the corner of the transfer belt 30 (on the extreme right of the body) via the paper conveyance path 206; the sheet S is conveyed to a fuser 300 to have the merged toner images fixed thereon.

The image forming units 10Y, 10M, 10C, and 10K forming images by the electrostatic copy method is provided with: a charger; a print head 21 including four laser diodes, a polygon mirror, a scanner lens, and the like; an exposure unit 20 including four reflection mirrors 22 and the like; development devices 9Y, 9M, 9C, and 9K; photoreceptor drums 11Y, 11M, 11C, and 11K; a transfer portion; and the like, which are all located in the vicinity of the image forming units themselves.

Above the image forming units 10Y, 10M, 10C, and 10K, toner cartridges 70Y, 70M, 70C, and 70K and sub-hoppers 80Y, 80M, 80C, and 80K are provided as a supplier feature which feeds toner in the development devices 9Y, 9M, 9C, and 9K of the image forming units 10Y, 10M, 10C, and 10K, respectively.

The toner cartridges 70Y, 70M, 70C, and 70K are removably loaded on the body 51A so as to be replaced with new ones when need. The toner cartridges 70Y, 70M, 70C, and 70K have a fuse attached thereto but not illustrated in this drawing; the body 51A detects an unused state of the toner cartridges when their fuses are conductive, and releases the unused state when the fuses are cut out. In other words, cutting the fuses, the toner cartridges are recognized as new ones having been loaded.

In FIG. 1, a portion with the number 400 is a communicator communicating with external machines, and a portion with the number 500 is an operation panel provided with a set of keys and a display.

Figure 3:
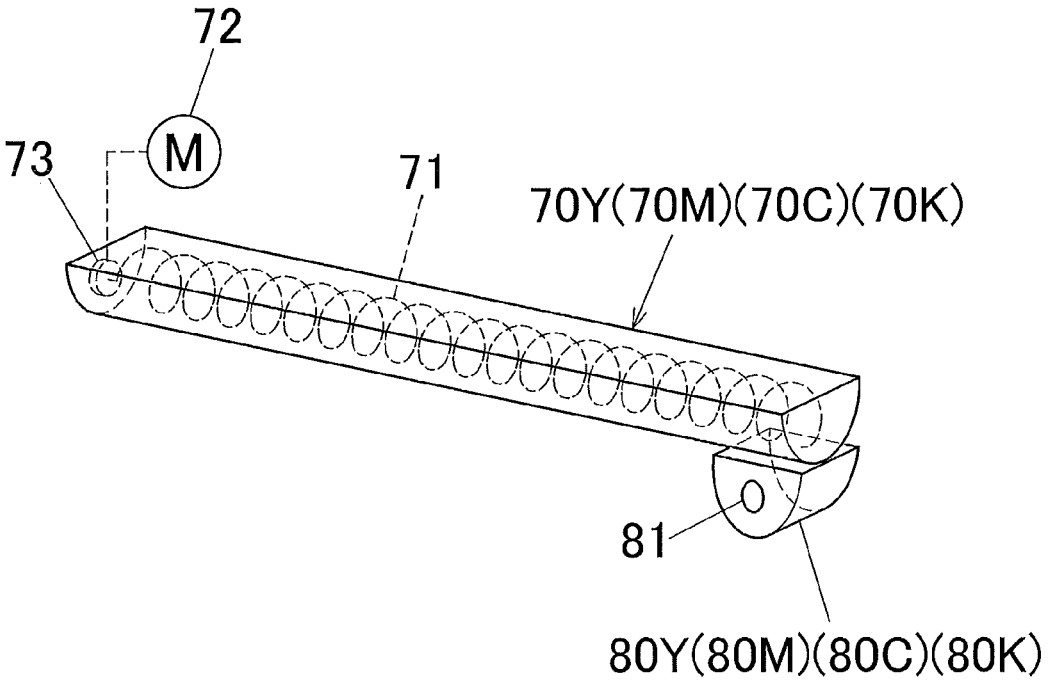
FIG. 3 is a view to explain a feature of the image forming apparatus to feed toner in a sub-hopper from a toner cartridge.

FIG. 3 is a view to explain a feature to feed toner in the sub-hoppers 80Y, 80M, 80C, and 80K from the toner cartridges 70Y, 70M, 70C, and 70K, respectively.

As illustrated in FIG. 3, when the toner cartridges 70Y, 70M, 70C, and 70K are loaded on the body 51A, the sub-hoppers 80Y, 80M, 80C, and 80K open shutters on their top to receive toner from the toner cartridges 70Y, 70M, 70C, and 70K.

The toner cartridge 70Y, 70M, 70C, and 70K have a spiral spring 71 inside, and feed toner in the sub-hoppers 80Y, 80M, 80C, and 80K, respectively, by having their spiral springs 71 rotated by stepper motors (also referred to as cartridge motors) 72.

There provided two stepper motors 72 for the four spiral springs 71; one of the two works for the toner cartridges 70Y and 70M, and the other one works for the toner cartridges 70C and 70K. An even number of gears 73 are arranged between an inlet valve of the toner cartridges 70Y and 70C and an inlet valve for the toner cartridges 70K and 70M; when the stepper motors 72 perform normal rotation, the spiral springs 71 of the toner cartridges 70Y and 70C are properly rotated while the spiral springs 71 of the toner cartridges 70K and 70M are rotated idle, and when the stepper motors 72 perform reverse rotation, the spiral springs 71 of the toner cartridges 70Y and 70C are rotated idle while the spiral springs 71 of the toner cartridges 70K and 70M are properly rotated. Switching the stepper motors 72 between normal rotation and reverse rotation determines whether or not to allow the toner cartridges 70Y, 70M, 70C, and 70K to feed toner.

Figure 4:
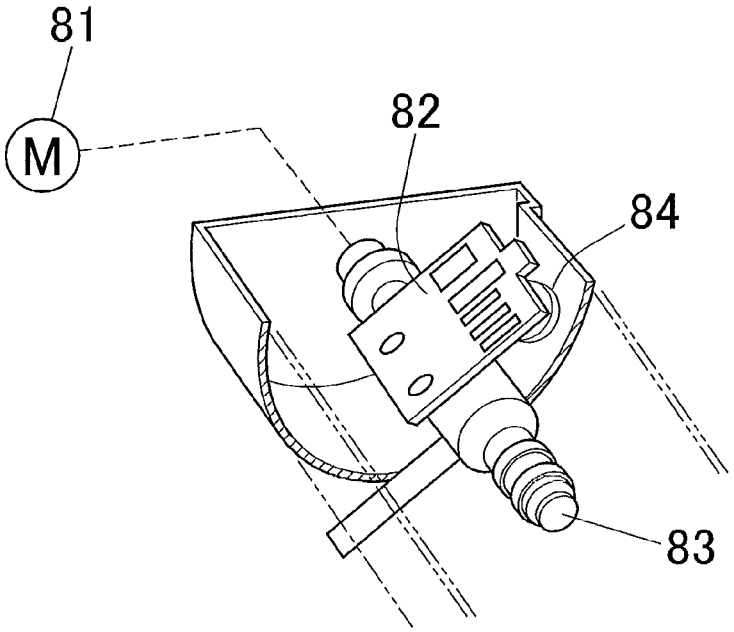
FIG. 4 is a view to explain a feature of the image forming apparatus to feed toner in a development device from the sub-hopper.

FIG. 4 is a view to explain a feature to feed toner in the development devices 9Y, 9M, 9C, and 9K from the sub-hoppers 80Y, 80M, 80C, and 80K.

As illustrated in FIG. 4, there provided one stepper motor (also referred to as sub-hopper motor) 81 for each of the sub-hoppers, the sub-hoppers 80Y, 80M, 80C, and 81K.

The sub-hoppers 80Y, 80M, 80C, and 80K feed toner in the development devices 9Y, 9M, 9C, and 9K, respectively, by having paddles 82 and spiral rollers 83 inside of themselves rotated by the sub-hopper motors 81. The remaining toner levels of the sub-hoppers 80Y, 80M, 80C, and 80K are detected by a toner empty sensor (piezoelectric sensor) 84.

Figure 5:
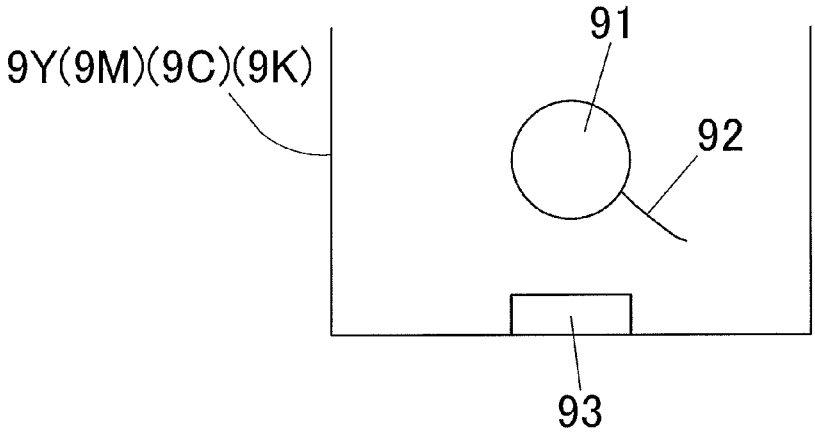
FIG. 5 is a view schematically illustrating a configuration of a feature to measure toner concentration.

FIG. 5 is a view schematically illustrating a configuration of a feature to measure toner concentration.

As illustrated in FIG. 5, the development devices 9Y, 9M, 9C, and 9K is filled with developing agent (toner and carrier); the developing agent in the development devices 9Y, 9M, 9C, and 9K is stirred by a Mylar plastic fin 92 attached to a motor-driven screw agitator 91. While the developing agent in the periphery of a toner concentration sensor 93 provided on the bottom of the development devices 9Y, 9M, 9C, and 9K is stirred by the Mylar plastic fin 92, new developing agent is let in the periphery of the toner concentration sensor 93. In other words, the developing agent in the periphery of the toner concentration sensor 93 is replaced with new one every other turn (ripple) of the screw agitator 91.

The toner concentration sensor 93 is a TCR sensor (magnetic sensor), for example. The toner concentration sensor 93 measures the toner concentration of the developing agent by reading out the magnetic permeability of iron included in the carrier of a unit volume of the developing agent in the periphery of the toner concentration sensor 93. That is, the higher a converted value (10-bit resolution) of an analog signal read out by the toner concentration sensor 93 is, the lower the toner concentration is.

Figure 6:
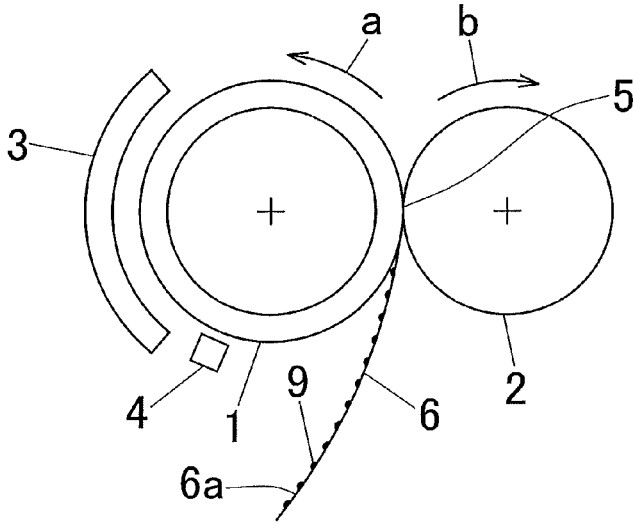
FIG. 6 is a view to explain a fuser.
Figure 7:
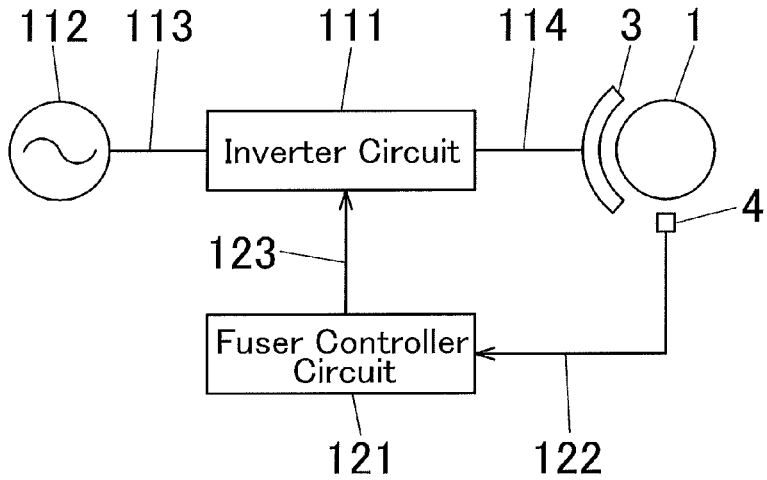
FIG. 7 is another view to explain the fuser.

FIGS. 6 and 7 are views to explain the fuser 300.

The fuser 300 is provided with a fuser roller 1 for fusing, a pressure roller 2 for applying pressure, an electromagnetic induction coil 3, and a temperature sensor 4 for sensing temperatures. The fuser roller 1, the pressure roller 2, the electromagnetic induction coil 3, and the temperature sensor 4 are mounted at the specified positions on the body of the fuser 300 such as a frame not illustrated in this Figure.

The fuser roller 1 and the pressure roller 2 are brought into close contact with each other and pressed against each other by a biasing portion such as a spring not illustrated in this Figure, in order to create a nip area 5 to let paper 6 go through. In case of a paper jam, the pressure roller 2 can be removed to resolve the trouble, although the electromagnetic induction coil 3 and the fuser roller 2 cannot. Meanwhile, the fuser roller 1 and the pressure roller 2 can be replaced with new ones when they are too old, although the electromagnetic induction coil 3 cannot.

As illustrated in FIG. 6, the fuser roller 1, the pressure roller 2, the electromagnetic induction coil 2, and the temperature sensor 4 are mounted on the frame. The fuser roller 1 is rotated by a driving source (such as a motor) not illustrated in this Figure, in the direction indicated by the Arrow a (in the anti-clockwise direction), and the pressure roller 2 is rotated with the motion in the direction indicated by Arrow b (in the clockwise direction in FIG. 6). In the fusing process, the paper 6 carrying toner 9 on one side thereof 6*a* is conveyed upwardly through the nip area 5 as illustrated in FIG. 6. By the fusing process, the toner 9 is fused and firmly fixed on the paper 6.

The fuser roller 1 is a cored iron bar having thereon a layer of Si (silicone) sponge rubber with the thickness of 5 mm; a layer of Ni—Cr (nickel-chromium) alloy with the thickness of 50 μm; a layer of Si rubber with the thickness of 1 mm; and a superficial layer of PFA (tetrafluoroethylene-perfluoroalkyl vinyl ether copolymer) with the thickness of 20 μm. The pressure roller 2 is a cored iron bar having thereon a layer of Si foam rubber with the thickness of 5 mm and a superficial layer of PFA with the thickness of 30 μm.

The electromagnetic induction coil 3, which is curved along and positioned near the outer peripheral surface of the fuser roller 1, directly heats the layer of Ni—Cr alloy included in the fuser roller 1 by electromagnetic induction effects. More specifically, the electromagnetic induction coil 3 is provided with a lead wound several times just like layers formed thereon, and while supported by a ferrite core and a ferrite core holder, the wound lead is curved along and positioned near the outer peripheral surface of the fuser roller 1.

And the magnetic flux generated by the electromagnetic induction coil 3 is applied to a magnetic circuit which is constructed of the ferrite core and the layer of Ni—Cr alloy of the fuser roller 1.

The temperature sensor 4, which is positioned against the outer peripheral surface of the fuser roller 1, senses the temperature of the surface of the fuser roller 1 by the infrared temperature sensing method which is well-known. The temperatures sensed by the temperature sensor 4 are transferred to a fuser controller circuit 121 (to be described later) via a line 122.

FIG. 7 is a block diagram illustrating a configuration of the control system to control the fusing process described with reference to FIG. 6, which is the base technology of the present invention. For the sake of brevity, the pressure roller 2 is omitted in FIG. 7.

As illustrated in FIG. 7, an inverter circuit 111 is provided between a commercial power supply (AC power supply) 112 and the electromagnetic induction coil 3. The inverter circuit 111 converts alternating-current power inputted from the commercial power supply 112 via a commercial power supply route 113, into a high-frequency alternating-current power, and then outputs the obtained high-frequency power to the electromagnetic induction coil 3 via a high-frequency power supply route 114.

Then, the fuser controller circuit 121 serving as a fuser controller provides a control signal including the specified power to the inverter circuit 111, according to the detection signal from the temperature sensor 4. The specified power is the amount of power that the inverter circuit 111 is required to output. The procedure is cooperatively performed in this way by the fuser roller 1, the temperature sensor 4, the fuser controller circuit 121, and the inverter circuit 111, and feedback control is implemented by repeating this procedure in a loop so that the temperature of the surface of the fuser roller 1 can be continuously adjusted to the optimal (target) fuser temperature. The fuser controller circuit 121 as described above is configured by a CPU (Central Processing Unit) for example. The fuser controller circuit 121 may control only the fuser 300, or may control an entire apparatus superordinate to the fuser controller circuit 121, for example a part of the control circuit to control the entire image forming apparatus 51.

The fuser controller circuit 121 judges whether or not the temperature of the surface of the fuser roller 1 is higher than the optimal (target) fuser temperature, and if the temperature of the surface of the fuser roller 1 is lower than the optimal (target) fuser temperature, the fuser controller circuit 121 increases the specified power. With increase of the specified power, a larger amount of power is inputted to the electromagnetic coil 3 from the inverter circuit 111, which increases the temperature of the surface of the fuser roller 1. Alternatively, if the temperature of the surface of the fuser roller 1 is higher than the optimal (target) fuser temperature, the fuser controller circuit 121 reduces the specified power. With reduction of the specified power, a smaller amount of power is inputted to the electromagnetic coil 3 from the inverter circuit 111, which decreases the temperature of the surface of the fuser roller 1.

Hereinafter, fuser power control will be described.

The controlled power to eliminate the difference between the fuser temperature actually sensed by the temperature sensor 4 and the optimal (target) fuser temperature is obtained from the table of FIG. 8. The controlled power is the amount of the power input to the IH heater, which is obtained from the table of FIG. 8, for example during the stand-by or printing state.

Hereinafter, the power restriction control will be described.

If the options of ADF, paper feeding, and paper discharging installed on the image forming apparatus 51, the total current possibly may exceed 15 A because of the concurrent execution of some of the options. To prevent this trouble, it is necessary to control the power input to the IH heater so that the total current cannot exceed 15 A.

During the printing state, the amount of IH (induction heating) power to be reduced is determined based on the color mode and the AD value on the current monitor of the 24V power supply, according to the table of FIG. 9.

The following are the cases in which the amount of IH power to be reduced is not 0 watts because the AD value on the current monitor of the 24V power supply is larger than a certain value.

[1] A particular type of paper which takes much amount of heat from the fuser is used for making copies, or many copies are made with a high ratio of B (black) to W (white).

[2] The fuser, not yet heated enough is used for the first time for the day, for continuously making copies.

[3] A plurality of options requiring rather much power (finisher, ADF, and the like) are installed on the image forming apparatus, and some of them are running at the same time (for example, while sheets of paper are continuously read by the ADF, the printed sheets are stapled by the finisher).

These are just some of the cases.

Losing enough IH power for the fusing process, the controlled power as previously described cannot be obtained and the current fuser temperature goes down. If a print operation is performed with the fuser temperature much lower than the optimal (target) fuser temperature, permanent images cannot be perfectly created on the paper because of bad fusing.

To prevent this trouble, if the current fuser temperature goes down lower than the optimal (target) fuser temperature during the printing state, the interval between sheets of paper is set longer than normal so that the amount of heat taken by the paper can be recovered during the intervals, that is, the fuser temperature can be continuously adjusted to the optimal (target) fuser temperature. FIG. 10 is a table illustrating the optimal level of productivity based on the optimal (target) fuser temperature.

The image forming apparatus 51 decreases the printing productivity by setting a larger interval between sheets of paper according to the table of FIG. 10.

With decrease of the productivity, the information of it is backed up on a nonvolatile recording medium of the image forming apparatus 51 so that the log can be referred to later.

Figure 11:
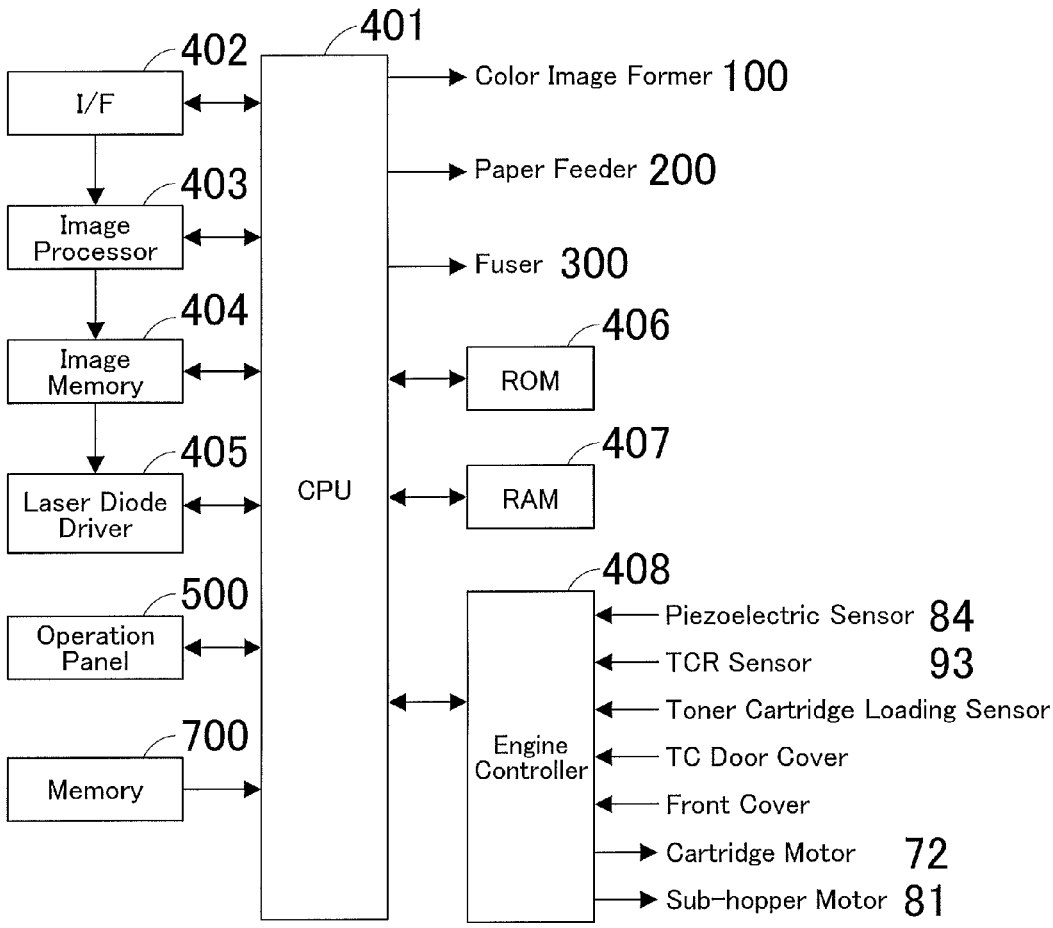
FIG. 11 is a block diagram illustrating a configuration of a controller of the image forming apparatus of FIG. 2.

FIG. 11 is a block diagram illustrating a configuration of a controller of the image forming apparatus 51.

As illustrated in FIG. 11, the controller includes a CPU 401, a communication interface (I/F) 402, an image processor 403, an image memory 404, a laser diode driver 405, an operation panel 500, a recording medium 700, a ROM 406, a RAM 407, and an engine controller 408, as primary members.

The CPU 401 integrally controls all operations of the image forming apparatus 51. Also, the CPU 401 reads out a necessary program from the ROM 406; converts image data by the image processor 403; writes and reads image data in and out from the image memory 404; and controls the fuser 300. Furthermore, the CPU 401 contributes to smooth printing operation by nicely arranging the times of a series of continuous operations of the color image former 100, the paper feeder 200, and the like. Furthermore, the CPU 401 detects (determines) a toner near empty state and an empty state of the toner cartridge 70Y, 70M, 70C, and 70K based on various information inputted from the engine controller 408; arranges the time of detecting (determining) a toner near empty state based on an indicated amount of fed toner and print log data; and displays a predetermined message about the time for replacing the toner cartridges 70Y, 70M, 70C, and 70K, on the operation panel 500. Furthermore, the CPU 401 manages life information of various consumable units such as toner cartridges, a transfer belt unit, a fuser unit, and imaging units such as development units including photoreceptor drums; and transmits the life information to the management server 50 in response to an inquiry from the management server 50.

The communication I/F 402 serves to connect the image forming apparatus 51 to a LAN such as a LAN card or a LAN board, and externally receives data to be printed out according to a print job and transfers it to the image processor 403.

Also, the communication I/F 402 transmits toner empty information, alert information, trouble information, and information of various printing events to the management server 50 managing the image forming apparatus 51 (see FIG. 13) via the Internet, and receives data and an instruction from the administration server 50.

Receiving data to be printed out according to a print job from the communication I/F 402, the image processor 403 converts the data into Y, M, C, and K image data objects for color reproduction and outputs the image data objects to the image memory 404 to have them stored thereon.

Reading out Y, M, C, and K image data objects from the image memory 404, the laser diode driver 405 drives the laser diodes of the exposure unit 20.

The operation panel 500 allows users to perform entry operations and displays various messages for them.

The recording medium 700 stores print log data, toner cartridge replacement log data, and the like, as well as various other data and applications.

The ROM 406 stores programs to control image forming operation and other data such as a table serving for toner supply control, toner empty detection control, and other controls.

The RAM 407 serves as a work area for the CPU 402.

Receiving signals and state information from the toner empty sensor 84, the TCR sensor 93, a toner cartridge loading sensor (not illustrated in the drawing), a TC door sensor (not illustrated in the drawing), a front cover (not illustrated in the drawing), the cartridge motors 72, the sub-hopper motors (not illustrated in the drawing), and the like, the engine controller 408 controls printing operation.

Figure 12:
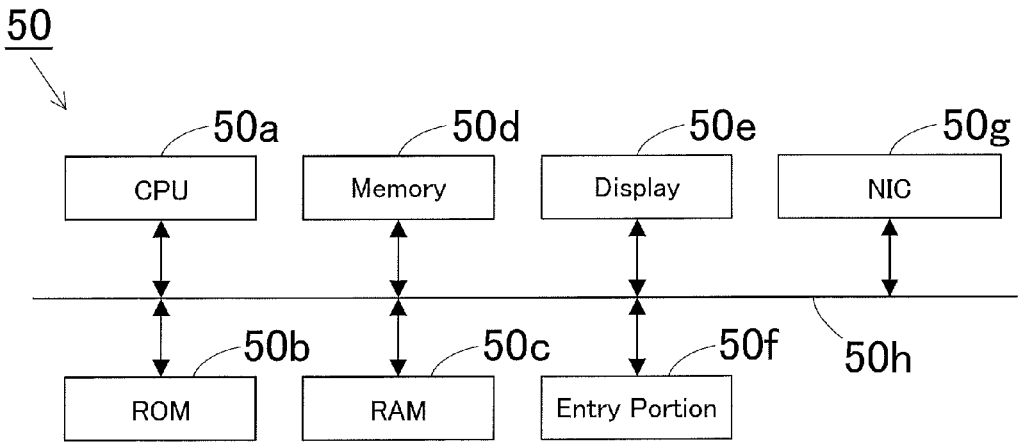
FIG. 12 is a block diagram illustrating a configuration of a replacement toner cartridge management apparatus.

FIG. 12 is a block diagram illustrating a configuration of the management server 50 employed in the replacement toner cartridge management system of FIG. 1.

The management server 50 is provided with a CPU 50*a*, a ROM 50*b*, a RAM 50*c*, a display 50*e*, an entry portion 50*f*, a network interface card (NIC) 50*g*, and the like, which are connected to each other via a system bus 50*h*.

The CPU 50*a* integrally controls the entire management server 50 by executing programs stored on the ROM 50*b*. Specifically, in this mode of embodied implementation, the CPU 50*a* manages information of remaining toner which is a remaining resource contained in the toner cartridges 70Y, 70M, 70C, and 70K loaded on the image forming apparatuses 51; information indicating that the toner cartridges 70Y, 70M, 70C, and 70K have been replaced with new ones; and other information which are received from the image forming apparatuses 51, and updates the information when the need arises. Also, receiving an instruction to deliver a specified type of replacement toner cartridge from an image forming apparatus 51, the CPU 50*a* transfers the delivery instruction to the order receiving server 52. Alternatively, receiving toner cartridge replacement information indicating that the toner cartridge 70Y, 70M, 70C, or 70K has been replaced or toner near empty information indicating that the toner cartridge 70Y, 70M, 70C, or 70K is nearly empty, the CPU 50*a* determines the right type of replacement toner cartridge and outputs a delivery instruction to the order receiving server 52.

The ROM 50*b* is a recording medium that stores programs and data for the CPU 50*a* to execute processing.

The ROM 50*c* is a recording medium that provides a work area for the CPU 50*a* to execute processing according to an operation program.

The recording medium 50*d* is, for example, a hard disk drive, and stores various data, applications, and the like. Specifically, in this mode of embodied implementation, the recording medium 50*d* stores remaining toner information of the toner cartridges 70Y, 70M, 70C, and 70K loaded on the image forming apparatuses 51, which is rewritable thereon. Furthermore, the recording medium 50*d* stores information, for example addresses to which replacement toner cartridges and replacement consumable units will be delivered and used in place of the toner cartridges, the transfer belt unit, the fuser unit, and the development units loaded on the image forming apparatuses 51.

The display 50*e* is, for example, a CRT display or a liquid-crystal display, and displays various messages, entry accepting screens, selection screens, and other screens for administrator-level users and other users.

The entry portion 50*f* serves for administrator-level users and other users to perform entry operation, and includes a keyboard, a mouse, and the like.

The network interface card 50*g* serves as a communicator that exchanges data with the image forming apparatuses 51 and the order receiving server 52 via the Internet network.

Figure 13:
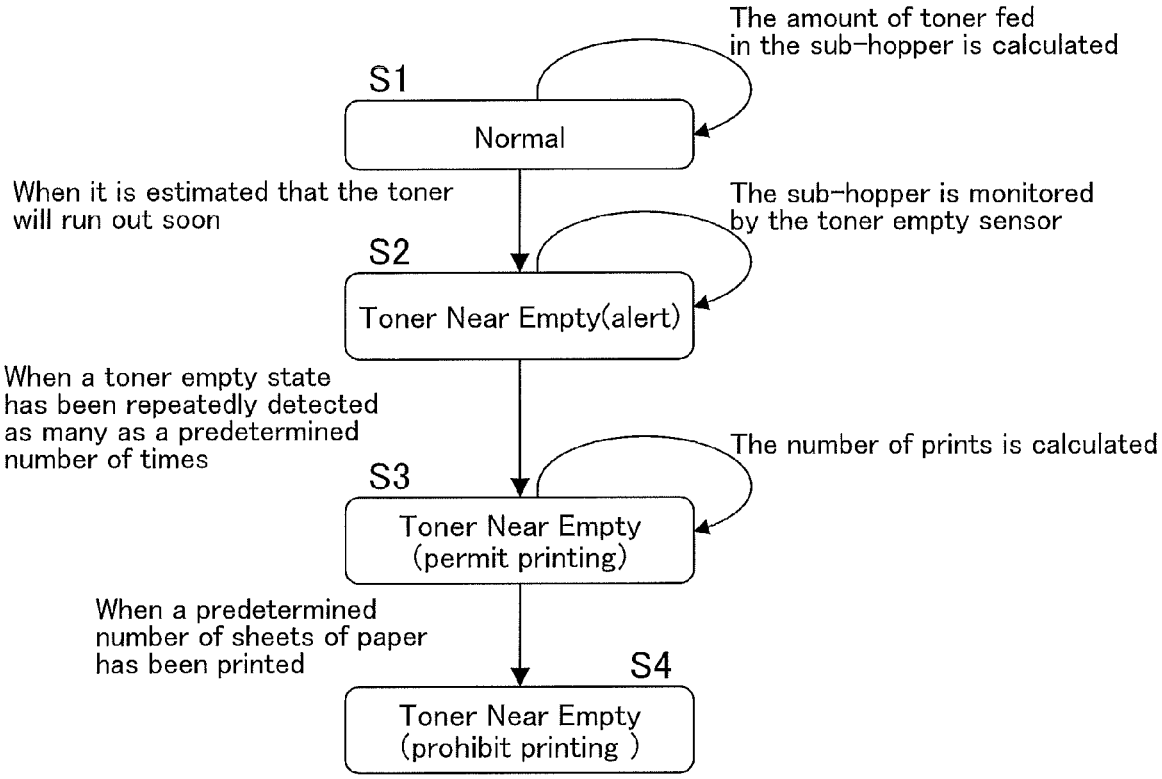
FIG. 13 is a flowchart representing a processing routine to detect an empty toner cartridge.

FIG. 13 is a flowchart representing a processing routine to detect an empty toner cartridge, executed by the image forming apparatuses 51.

In FIG. 13, the remaining toner levels of the toner cartridges 70Y, 70M, 70C, and 70K slowly go down with feeding of toner; the toner cartridges 70Y, 70M, 70C, and 70K eventually run out of toner (become empty).

There are the four states depending on remaining toner level: "normal" (Step S1), "toner near empty (alert)" (Step S2), "toner empty (permit printing)" (Step S3), and "toner empty (prohibit printing)" (Step S4).

Unlike "toner near empty (alert)" (Step S2), "toner empty (permit printing)" (Step S3), and "toner empty (prohibit printing)" (Step S3), "normal" (Step S1) means that the toner cartridges 70Y, 70M, 70C, and 70K and the sub-hoppers 80Y, 80M, 80C, and 80K are sufficiently filled with toner. In these four states including the state of "normal" (Step S1), the CPU 401 accumulates the rotation quantum numbers of the cartridge motors 72, and estimates the amount of toner fed in the sub-hoppers 80Y, 80M, 80C, and 80K based on the rotation quantum numbers.

The CPU 401 determines the state as "toner near empty (alert)" (Step S2) if estimating that the toner cartridges 70Y, 70M, 70C, and 70K nearly run out of toner based on the estimated amount of toner fed in the sub-hoppers 80Y, 80M, 80C, and 80K. In the state of "toner near empty (alert)", as illustrated in FIG. 9, an alert message stating that toner will run out in a short time is displayed on the operation panel 500 so that users will be encouraged to prepare a replacement toner cartridge. After that, thousands of prints still can be made using the toner cartridges 70Y, 70M, 70C and 70K before "toner empty (prohibit printing)" is detected, users therefore have enough time to prepare a replacement toner cartridge even when need to place an order because of no replacement toner cartridges in stock.

The CPU 401 determines the state as "toner empty (permit printing)" (Step S3) when the toner empty sensor 84 has repeatedly detected a toner empty state of the sub-hoppers 80Y, 80M, 80C, and 80K as many as a predetermined number of times. In this state, the toner cartridges 70Y, 70M, 70C, and 70K have no toner left inside while the sub-hoppers 80Y, 80M, 80C, and 80K still contain toner for as many as 100 prints approximately, and printing is therefore permitted.

The CPU 401 determines the state as "toner empty (prohibit printing)" (Step S4) when the sub-hoppers 80Y, 80M, 80C, and 80K run out of toner by further consuming it for a predetermined number of prints after "toner empty (permit printing)" is detected. In this state, printing is prohibited.

In the state of "toner near empty (alert)" (Step S2) and "toner empty (permit printing)" (Step S3), as illustrated in FIG. 14, an alert message is displayed on the operation panel 500 to let the user know that the toner will run out soon. In the state of "toner empty (prohibit printing)" (Step S4), a strong alert message is displayed on the operation panel 500 to let the user know that the toner has run out, and printing is prohibited.

These states depending on remaining toner level: normal, toner near empty, toner empty (permit printing), and toner empty (prohibit printing) (described in Steps S1 to S4, respectively) are incorporated in a table illustrated in FIG. 15.

As is obviously understood from the table of FIG. 15, when the state turns to "toner empty (permit printing)" (Step S3), it is acceptable to replace the toner cartridges 70Y, 70M, 70C, and 70K with new ones since these contain little remaining toner (almost run out of toner); when the state turns to "toner near empty" (Step S2), it is not preferred to replace the toner cartridges 70Y, 70M, 70C, and 70K with new ones since these still contain some remaining toner.

Figure 16:
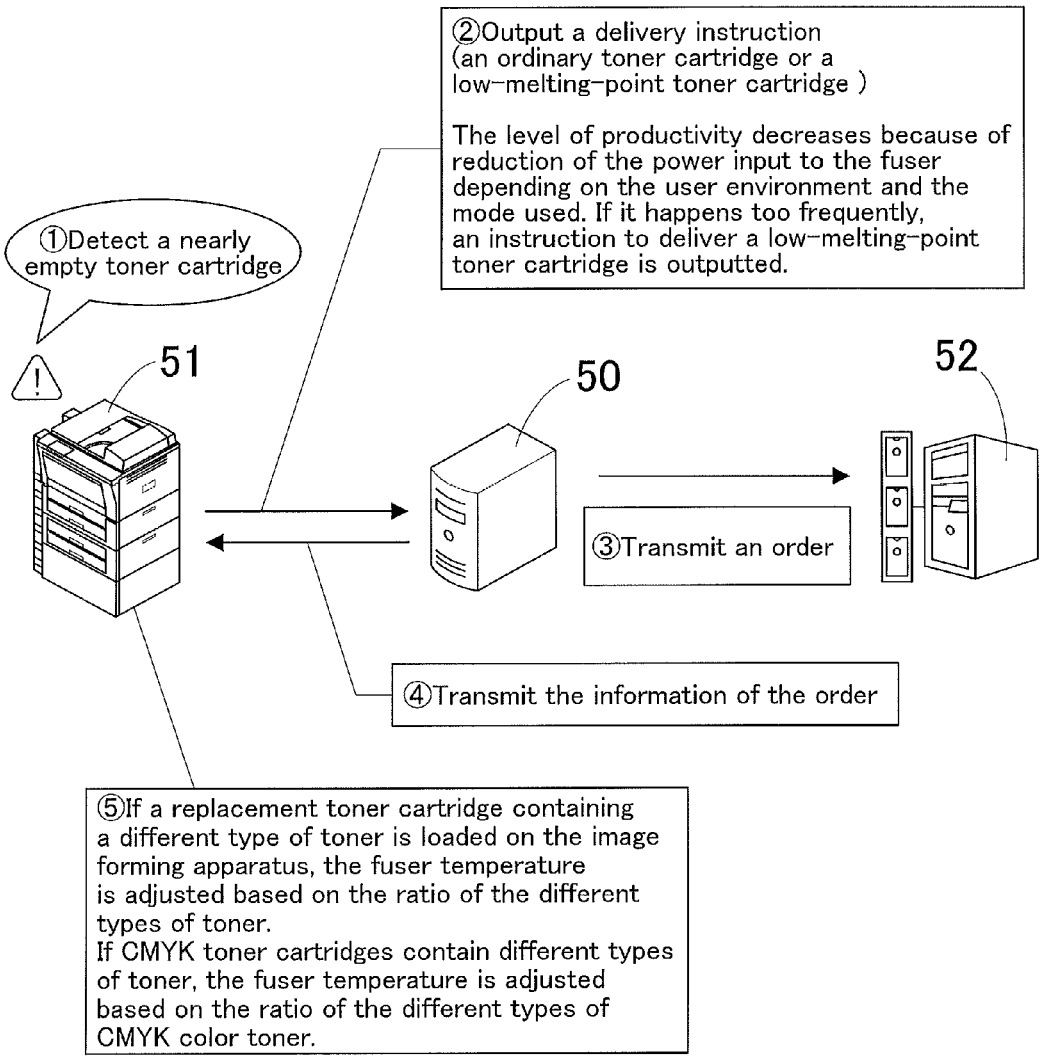
FIG. 16 is a view to explain the overview of the procedure to determine the right type of replacement toner cartridge; output a delivery instruction; have a delivered replacement toner cartridge loaded on the image forming apparatus; and start the implementation of the fuser temperature control, which is executed by the replacement toner cartridge management system according to the mode of embodied implementation.

FIG. 16 is a view to explain the overview of the procedure to determine the right type of replacement toner cartridge; output a delivery instruction; have a delivered replacement toner cartridge loaded on the image forming apparatus 51; and start the implementation of the fuser temperature control, which is executed by the replacement toner cartridge management system according to the mode of embodied implementation.

In this example, receiving from an image forming apparatus 51, information indicating that the toner cartridge 70Y, 70M, 70C, or 70M is nearly empty, the management server 50 outputs an instruction to deliver a replacement toner cartridge.

To begin with, a toner cartridge loaded on an image forming apparatus 51 becomes nearly empty (circled number 1). Then the image forming apparatus 51 determines the right type of replacement toner cartridge and outputs a delivery instruction to the management server 50 connected therewith via a communication circuit (circled number 2).

And if the productivity is decreased too often because of the reduction of the power input to the fuser 300 depending on the user environment or the mode used, an instruction to deliver a low-melting-point toner cartridge filled with the toner requiring a lower fuser temperature is outputted. The method of determining the right type of replacement toner cartridge will be described later.

Receiving an instruction to deliver the right type of replacement toner cartridge from the image forming apparatus 51, the management server 50 transfers the delivery instruction (an order) to the order receiving server 52 (circled number 3).

And then, just in case if an order cannot be submitted, the management server 50 returns the information indicating the type of replacement toner cartridge having been ordered, to the image forming apparatus 51 (circled number 4).

Receiving the information indicating the type of the ordered replacement toner cartridge and the information indicating that this type is different from the current one, the image forming apparatus 51 performs the fuser temperature control based on the amount of toner supplied from a replacement toner cartridge to be loaded thereon. If the CMYK toner cartridges loaded on the image forming apparatus contain different types of toner, the image forming apparatus 51 adjusts the fuser temperature control based on the amount of toner supplied from replacement CMYK toner cartridges to be loaded thereon and the proportion of the CMYK toner used for image forming (circled number 5).

Figure 17:
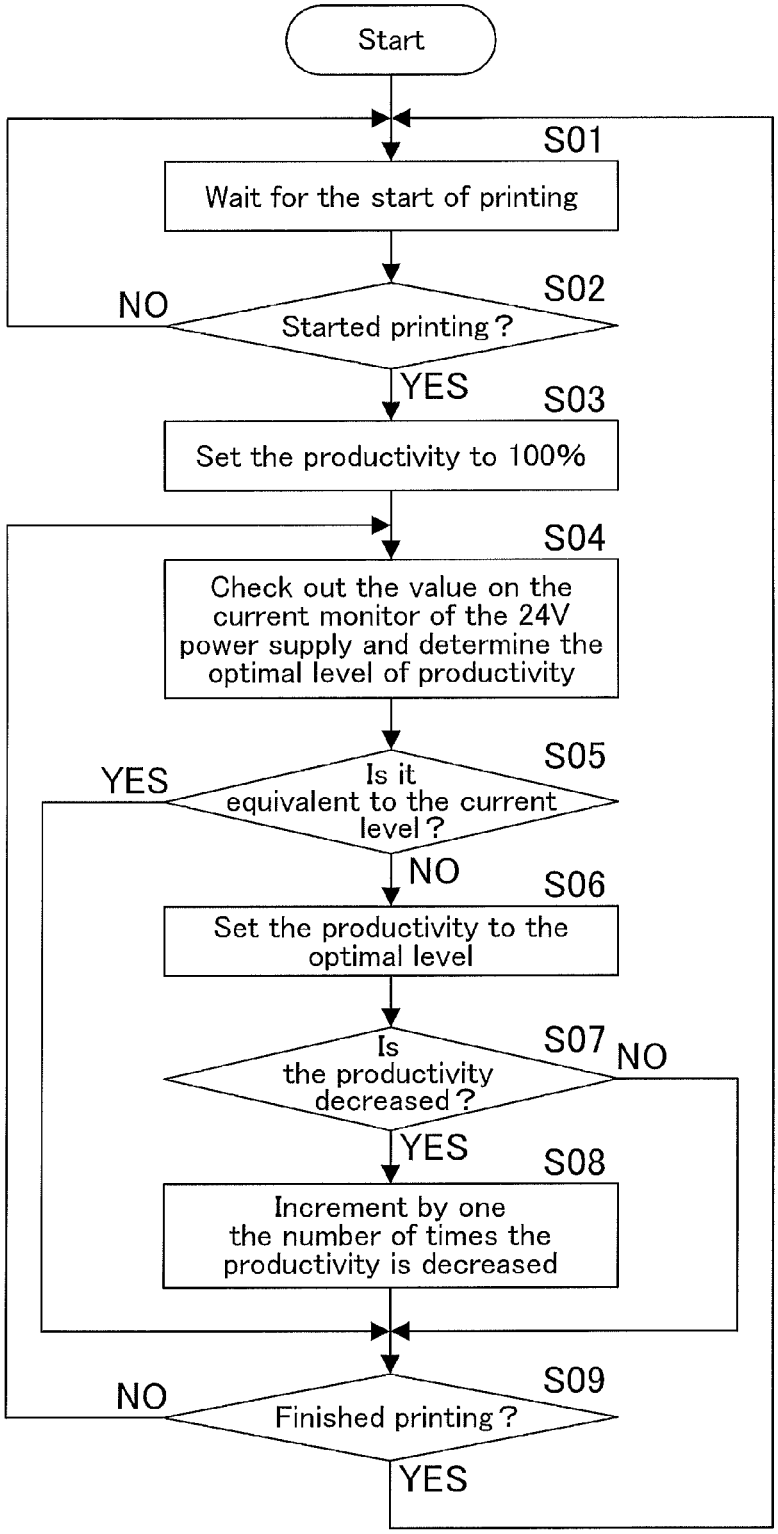

FIG. 17 is a flowchart representing a processing routine to count how many times the productivity has been decreased so that the right type of replacement toner cartridge can be determined based on that number of times. The flowcharts in FIG. 17 and its following Figures are executed by the CPU 401 of the image forming apparatus 51 according to operation programs stored on a recording medium such as the ROM 406.

The routine waits for the start of a print operation in Step S01, and it is judged whether or not a print operation is started in Step S02. If a print operation is not started (NO in Step S02), the routine goes back to Step S01. If a print operation is started (YES in Step S02), the productivity is set to 100% as an initial value in Step S03 (the productivity is kept to normal). After a print operation is started, the value on the current monitor of the 24V power supply is checked out and the optimal level of productivity is determined based on the value in Step S04. Normally, the productivity does not need to be decreased. However, the power input to the fuser heater is sometimes reduced depending on the state of the process of the fuser 300 or the use of the options, then the current fuser temperature goes down. In such a case, the productivity needs to be decreased.

Then in Step S05, it is judged whether or not the optimal level of productivity determined in Step S04 is identical with the current level of productivity. If it is identical therewith (YES in Step S05), the routine proceeds to Step S09. If the optimal level of productivity determined in Step S04 is identical with the current level of productivity (NO in Step S05), the interval between sheets of paper is corrected so that the productivity is adjusted to the optimal level in Step S06.

The number of times the productivity is decreased is counted. In Step S07, it is judged whether or not the productivity is decreased. If the productivity is not decreased (NO in Step S07), the routine proceeds to Step S09. If the productivity is decreased (YES in Step S07), the number of times the productivity is decreased is incremented by one and the new number is backed up on the nonvolatile memory in Step S08. Then the routine proceeds to Step S09.

In Step S09, it is judged the print operation is finished. If it is not finished (NO in Step S09), the routine goes back to Step S04. If it is finished (YES in Step S09), the routine goes back to Step S01.

Figure 18:
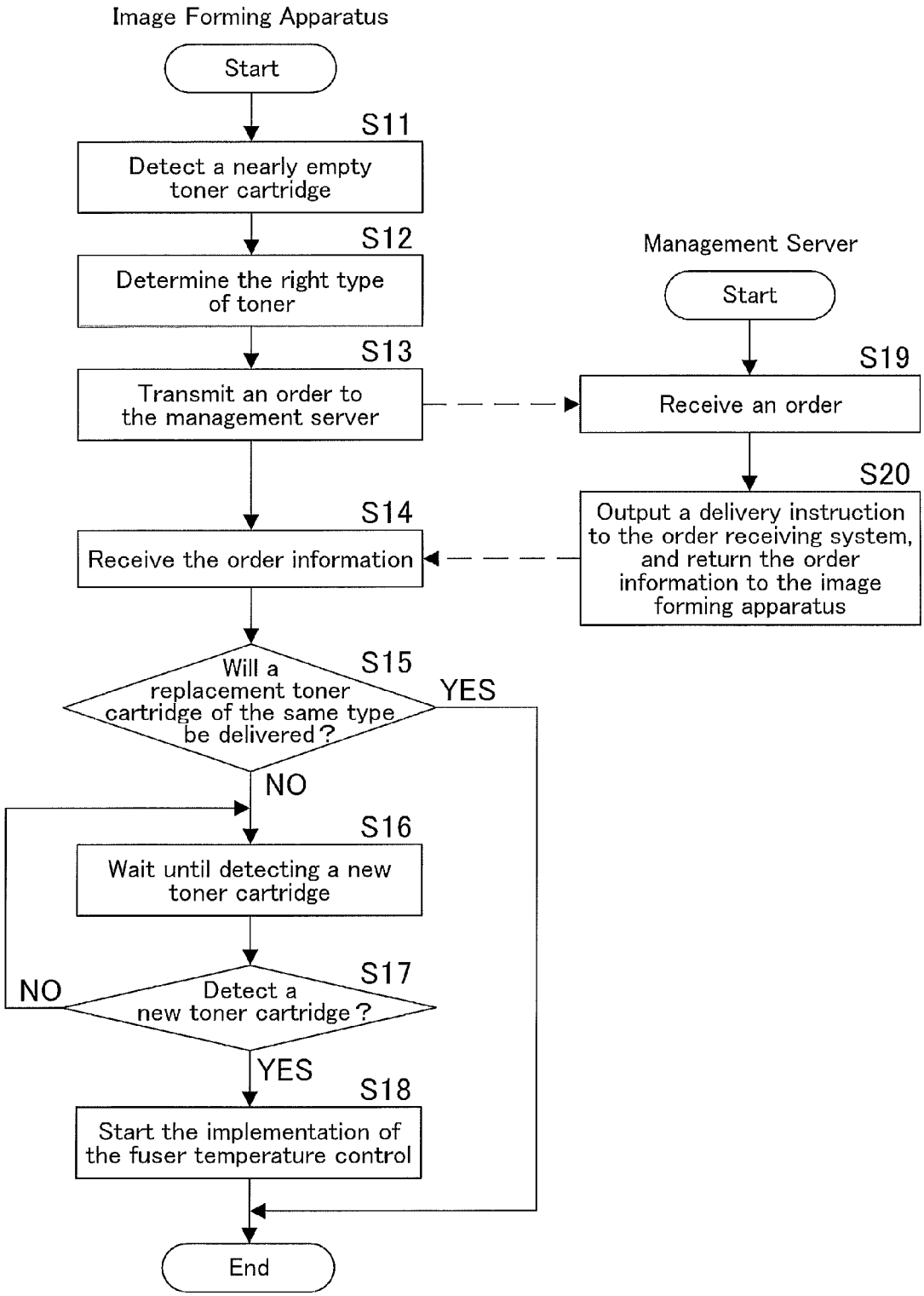
FIG. 18 is a flowchart representing a processing routine to execute the procedure of FIG. 16.

FIG. 18 is a flowchart representing a processing routine to execute the procedure of FIG. 16.

Initially, an image forming apparatus 51 detects a nearly empty toner cartridge in Step S11, and then determines the right type of toner in Step S12. The algorithm of the determination will be later described with reference to FIG. 19.

In Step S13, the image forming apparatus 51 outputs an instruction to deliver a replacement toner cartridge which is filled with the right type of toner determined in Step S12, to the management server 50. Receiving the delivery instruction in Step S19, the management server 50 transfers the delivery instruction to the order receiving server 52 and returns delivery instruction information including the type of replacement toner cartridge having been ordered, to the image forming apparatus 51. Having a communication route with the order receiving server 52, the management server 50 can output an instruction to deliver a different type of replacement toner cartridge if the type of replacement toner cartridge having been ordered is out of stock. That is why the management server 50 needed to return a notice of the type of replacement toner cartridge having been ordered, to the image forming apparatus 51.

Receiving the delivery instruction information from the management server 51 in Step S14, it is judged whether or not the type of replacement toner cartridge having been ordered is identical with the type of toner cartridge currently loaded on the image forming apparatus 51 in Step S15. If it is identical with it (YES in Step S15), the routine immediately terminates. If it is not identical with the type of toner cartridge currently loaded on the image forming apparatus 51 (NO in Step S15), the routine waits until the toner cartridge currently loaded thereon is replaced with a new one in Step S16. It is judged whether or not a new toner cartridge is detected in Step S17. If a new toner cartridge is not detected (NO in Step S17), the routine waits until it is detected. If a new toner cartridge is detected (YES in Step S17), it is recognized that the ordered replacement toner cartridge has been loaded and the implementation of the fuser temperature control is started in Step S18. The algorithm of the implementation of the fuser temperature control will be later described with reference to FIG. 20.

Figure 19:
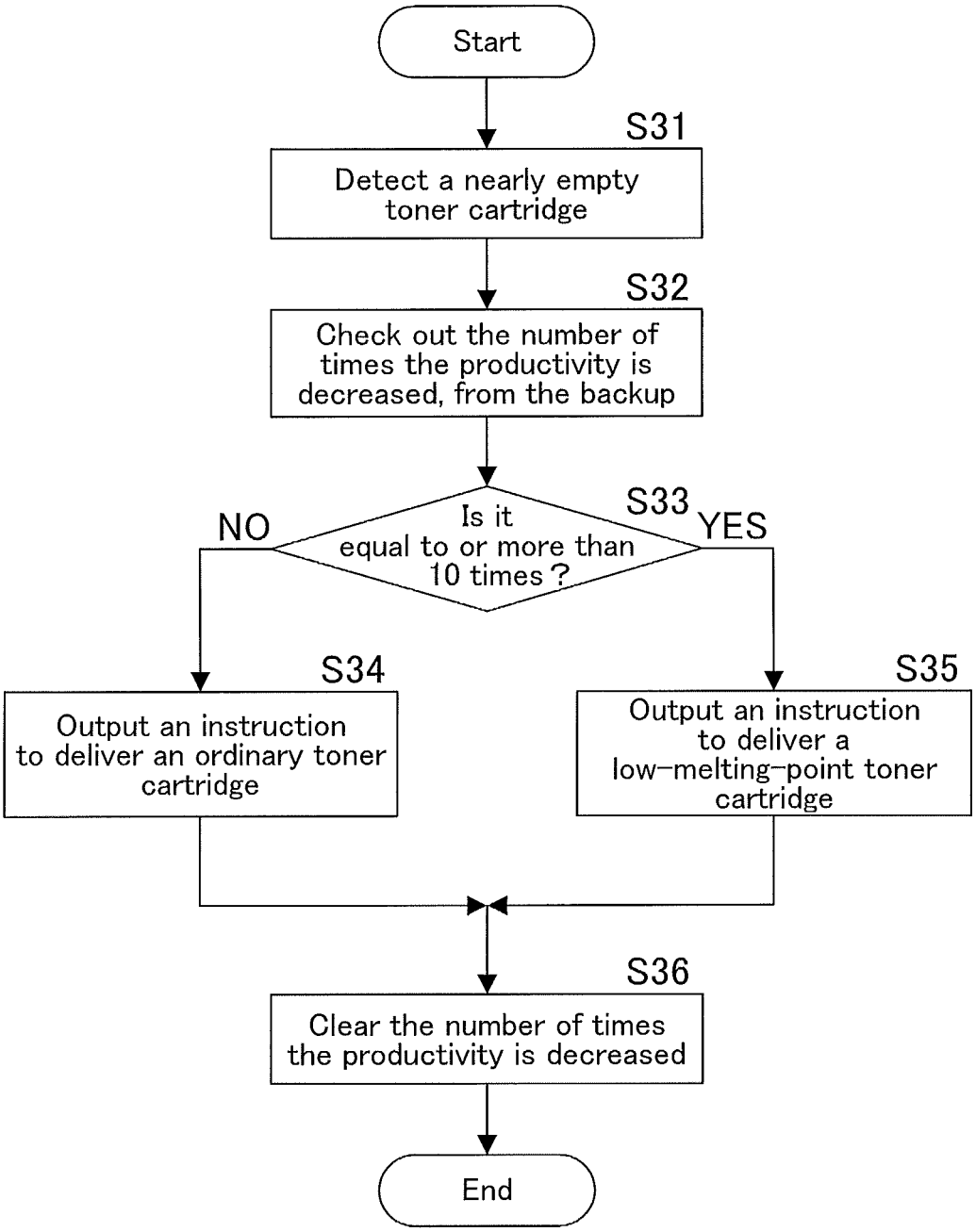
FIG. 19 is a flowchart representing a processing routine to determine the right type of replacement toner cartridge.

FIG. 19 is a flowchart representing a processing routine to determine the right type of replacement toner cartridge.

In this mode of embodied implementation, the right type of replacement toner cartridge can be selected between the following two types of toner cartridges: an ordinary toner cartridge and a low-melting-point toner cartridge. An ordinary toner cartridge and a low-melting-point toner cartridge contain the ordinary toner and the low-melting-point toner which require different optimal fuser temperatures, respectively; these two types of toner cartridges commonly have the same hardware configuration. A low-melting-point toner cartridge is filled with the toner requiring the optimal fuser temperature 140° C. (degrees Celsius), for example; an ordinary toner cartridge is filled with the toner requiring a higher temperature than the low-melting-point toner, the optimal fuser temperature 160° C. (degrees Celsius), for example. The optimal fuser temperature which is the target temperature pursued by the fuser temperature control depends on the characteristics of toner.

As illustrated in FIG. 19, an image forming apparatus 51 detects a nearly empty toner cartridge in Step S31, and then checks out the number of times the productivity is decreased as described in FIG. 17, from the nonvolatile memory in Step S32. In Step S33, it is judged whether or not the number of times the productivity is decreased is equal to or more than 10 times. If it is less than 10 times (NO in Step S33), an instruction to deliver an ordinary toner cartridge is outputted in Step S34. Then the routine proceeds to Step S36. If it is equal to or more than 10 times (YES in Step S33), an instruction to deliver a low-melting-point toner cartridge is outputted in Step S35. Then the routine proceeds to Step S36. In Step S36, the number of times the productivity is decreased is cleared.

Even if an ordinary toner cartridge is replaced with a low-melting-point toner cartridge, the ordinary toner in the development unit cannot be entirely and immediately replaced with the low-melting-point toner; the reverse also holds true. Therefore, the different types of toner temporarily remain mixed in the development unit. In order to completely fuse the toner to paper, it is necessary to change the optimal (target) fuser temperature depending on the ratio of the ordinary toner to the low-melting-point toner in the development unit.

Figure 20:
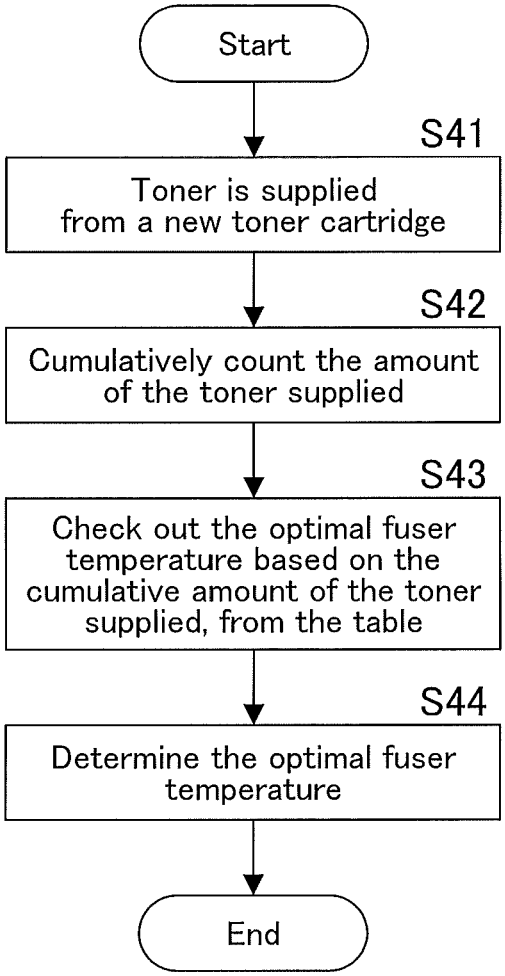
FIG. 20 is a flowchart representing a processing routine to change the optimal (target) fuser temperature.

FIG. 20 is a flowchart representing a processing routine to change the optimal (target) fuser temperature.

The image forming apparatus 51 activates the function of the fuser temperature control when detecting a new toner cartridge, then starts the implementation of the fuser temperature control when detecting toner fed from the new toner cartridge.

Toner is supplied from the new toner cartridge in Step S41, and the amount of the toner supplied from the new toner cartridge is cumulatively counted in Step S42. Then the optimal (target) fuser temperature based on the cumulative amount of the toner supplied is checked out from the table of FIG. 21, and the optimal (target) fuser temperature is determined in Step S44. If the current optimal (target) fuser temperature is different, it is updated with the determined one. Also, if the current optimal (target) fuser temperature is different, the temperature of the fuser roller is adjusted to the determined one.

FIG. 21 is a table illustrating the optimal (target) fuser temperature depending on the cumulative amount of toner fed from a new toner cartridge; FIG. 21*a* is a table to refer to when a low-melting-point toner cartridge is replaced with an ordinary toner cartridge, and FIG. 21*b* is a table to refer to when an ordinary toner cartridge is replaced with a low-melting-point toner cartridge.

As described above, in this mode of embodied implementation, a particular type of replacement toner cartridge containing the toner requiring a fuser temperature which is optimal for the power input to the fuser 300 can be delivered. And the user temperature is adjusted to the optimal (target) fuser temperature depending on the cumulative amount of toner fed from a new toner cartridge. Therefore, the toner fusing process is perfectly performed by the fuser temperature control, even when different types of toner with different characteristics are mixed in the development unit.

If the number of times the productivity is decreased by reducing the power input to the fuser, having been counted during a certain period of time is more than a predetermined value, a replacement toner cartridge filled with the toner requiring a lower fuser temperature will be delivered; if it is smaller than a predetermined value, a replacement toner cartridge filled with the toner requiring a higher fuser temperature will be delivered. In this way, the right type of toner can be effectively selected based on the log data of the power control and used.

Furthermore, the image forming apparatus 51 can recognize the type of replacement toner cartridge having been loaded, based on the information received from the management server 50, and performs the toner fusing process accordingly. Therefore, information indicating the type of toner does not have to be stored on each toner cartridge so that the image forming apparatus 51 can read the information, which contributes to the saving on the costs of toner cartridges.

Hereinafter, the case in which more than one type of toner cartridge is loaded on a color image forming apparatus 51 will be described.

The color image forming apparatus 51 uses four color CMYK toner cartridges. When these toner cartridges need to be replaced with new ones depends on the frequency of the use of these color toner. In this case, if all these ordinary toner cartridges are replaced with low-melting-point toner cartridges, the different types of these color toner are mixed in the development units, and the ratios of the ordinary toner to the low-melting-point toner in the respective development units may be totally different. To resolve this problem, it is necessary to correct the optimal (target) fuser temperatures.

In this mode of embodied implementation, the optimal (target) fuser temperatures are corrected according to the following formula.

Target Temperature (° C.)=*Y* Target Temperature (° C.)×
*Y* Image Ratio (%)+*M* Target Temperature (° C.)×
*M* Image Ratio (%)+*C* Target Temperature (° C.)×
*C* Image Ratio (%)+*K* Target Temperature (° C.)×
*K* Image Ratio (%)

The optimal (target) fuser temperatures for the four color toner are obtained from the table of FIG. 21. The image ratios (%) refer to the ratios of the four colors CMYK of permanent images to be printed on paper, which can be calculated by a dot counter, for example. It should be noted that Y Image Ratio (%)+M Image Ratio (%)+C Image Ratio (%)+K Image Ratio (%)=100%.

As described above, in this mode of embodied implementation, the image forming apparatus 51 displays a message requesting the user to confirm an order for a replacement toner cartridge on the operation panel 500, and outputs a delivery instruction after the user submits his/her order. Therefore, possible trouble with users over order confirmation can be prevented.

The mode of implementing the present invention has been described in the foregoing specification, which does not mean that the present invention shall be construed as limited to the particular forms disclosed. For example, the image forming apparatus 51 and the management server 50 with different functions from each other are provided in the replacement toner cartridge management system in this mode of embodied implementation, but the image forming apparatus 51 may have the functions of the management server 50. Having the functions of the management server 50, the image forming apparatus 51 outputs an instruction to deliver a replacement toner cartridge to the order receiving server 52.

Furthermore, in this mode of embodied implementation, the image forming apparatus 51 determines the right type of replacement toner cartridge. Alternatively, the management server 50 may receive information indicating the fusing process condition for image forming from the image forming apparatus 51, determine the right type of replacement toner cartridge, then return a notice of the determined type of replacement toner cartridge.

Furthermore, in the modes of embodied implementation, there is the order receiving server 52 and the management server 50 outputs a delivery instruction to the order receiving server 52. Alternatively, the management server 50 may output a message encouraging the users to place an order: on the display 50*e* of the management server 50 itself; on a display of another machine such as a personal computer; or on a display of the operation panel 500 of one of the image forming apparatuses 51 if it takes over the functions of the management server 50. In such a case, an order placement operation is manually performed.

Each of the following is one aspect of the present invention of the subject application having been described above: an image forming apparatus which is capable of performing the fuser temperature control for cost saving by selecting a right replacement toner cartridge based on the user's use and the like, among multiple color toner cartridges, for example which are filled with different types of toner requiring different optimal fuser temperatures, and delivering the selected replacement toner cartridge to the user; a replacement toner cartridge management apparatus; a replacement toner cartridge management system; a replacement toner cartridge management method; and recording mediums.

[1] An image forming apparatus is provided with:

an obtainer which obtains first information indicating a new toner cartridge having just been loaded thereon or a toner cartridge to be replaced with a new one and second information indicating the current condition under which a fusing process is performed for image forming;

a determiner which determines the right type of a replacement toner cartridge to be loaded in place of the toner cartridge causing the first information obtained by the obtainer, based on the second information also obtained by the obtainer;

an output portion which outputs an instruction to deliver a replacement toner cartridge of the type determined by the determiner;

a detector which detects a new toner cartridge having just been loaded thereon; and a fusing processor which performs a fusing process under the optimal condition based on the amount of the toner supplied from the detector's detected new toner cartridge which is a replacement toner cartridge delivered according to the delivery instruction outputted by the output portion.

[2] The image forming apparatus as recited in the aforementioned item [1], wherein:

a replacement toner cartridge of the type determined by the determiner is filled with the toner requiring a different optimal fuser temperature;

the current condition indicated by the second information is the power input to a fuser; and the optimal condition under which the fusing processor performs a fusing process is the target fuser temperature.

[3] The image forming apparatus as recited in the aforementioned item [2], wherein if the number of times the productivity is deceased by reducing the power input to the fuser, having been counted for a certain period of time is equal to or larger than a predetermined value, the determiner determines that a replacement toner cartridge filled with the toner requiring a lower fuser temperature should be delivered; or if it is smaller than the predetermined value, the determiner determines that a replacement toner cartridge filled with the toner requiring a higher fuser temperature should be delivered.

[4] The image forming apparatus as recited in the aforementioned item [1], wherein if multiple colors and types of toner are contained in toner cartridges, the fusing processor adjusts the fuser temperature for each page based on the ratio of the types of toner and the amounts of the respective colors of toner used for image forming.

[5] The image forming apparatus as recited in the aforementioned item [1], further provided with a receiver which externally receives information indicating that delivery has been arranged, wherein the fusing processor identifies the type of a replacement toner cartridge delivered according to the delivery instruction outputted by the output portion, from the information received by the receiver.

[6] The image forming apparatus as recited in the aforementioned item [1], wherein the output portion outputs the delivery instruction to an order receiving server which the image forming apparatus can access via a communication circuit to place an order for a consumable unit.

[7] A replacement toner cartridge management apparatus is provided with:

an obtainer which obtains from one or more than one image forming apparatus which the replacement toner cartridge management apparatus can access via a communication circuit, first information indicating a new toner cartridge having just been loaded thereon or a toner cartridge to be replaced with a new one and second information indicating the current condition under which a fusing process is performed for image forming;

a determiner which determines the right type of a replacement toner cartridge to be loaded in place of the toner cartridge causing the first information obtained by the obtainer, based on the second information also obtained by the obtainer;

an output portion which outputs an instruction to deliver a replacement toner cartridge of the type determined by the determiner; and a transmitter which transmits information indicating that delivery has been arranged, to the image forming apparatus, so that the image forming apparatus can perform a fusing process under the optimal condition based on the amount of the toner supplied from a replacement toner cartridge delivered according to the delivery instruction outputted by the output portion.

[8] The replacement toner cartridge management apparatus as recited in the aforementioned item [7], wherein:

a replacement toner cartridge of the type determined by the determiner is filled with the toner requiring a different optimal fuser temperature;

the current condition indicated by the second information is the power input to a fuser; and the optimal condition under which the image forming apparatus performs a fusing process is the target fuser temperature.

[9] The replacement toner cartridge management apparatus as recited in the aforementioned item [8], wherein if the number of times the productivity is deceased by reducing the power input to the fuser, having been counted for a certain period of time is equal to or larger than a predetermined value, the determiner determines that a replacement toner cartridge filled with the toner requiring a lower fuser temperature should be delivered; or if it is smaller than the predetermined value, the determiner determines that a replacement toner cartridge filled with the toner requiring a higher fuser temperature should be delivered.

[10] The replacement toner cartridge management apparatus as recited in the aforementioned item [7], wherein if multiple colors and types of toner are contained in toner cartridges, the image forming apparatus adjusts the fuser temperature for each page based on the ratio of the types of toner and the amounts of the respective colors of toner used for image forming.

[11] The replacement toner cartridge management apparatus as recited in the aforementioned item [7], wherein the output portion outputs the delivery instruction to an order receiving server which the replacement toner cartridge management apparatus can access via a communication circuit to place an order for a consumable unit.

[12] A replacement toner cartridge management system provided with one or more than one image forming apparatus and a management apparatus which can access each other via a communication circuit, wherein:

the image forming apparatus is provided with:

a transmitter which transmits first information indicating a new toner cartridge having just been loaded thereon or a toner cartridge to be replaced with a new one and second information indicating the current condition under which a fusing process is performed for image forming;

the management apparatus is provided with:

an obtainer which obtains the first information and the second information;

a determiner which determines the right type of a replacement toner cartridge to be loaded in place of the toner cartridge causing the first information obtained by the obtainer, based on the second information also obtained by the obtainer;

an output portion which outputs an instruction to deliver a replacement toner cartridge of the type determined by the determiner; and a transmitter which transmits information indicating that delivery has been arranged, to the image forming apparatus; and the image forming apparatus further is further provided with:

a detector which detects a new toner cartridge having just been loaded thereon; and an identification portion which identifies the type of a replacement toner cartridge delivered, from the information received from the transmitter of the management apparatus; and a fusing processor which performs a fusing process under the optimal condition based on the amount of the toner supplied from the detector's detected new toner cartridge which is a replacement toner cartridge delivered according to the delivery instruction outputted by the output portion of the management apparatus.

[13] The replacement toner cartridge management system as recited in the aforementioned item [12], wherein:

a replacement toner cartridge of the type determined by the determiner of the management apparatus is filled with the toner requiring a different optimal fuser temperature;

the current condition indicated by the second information is the power input to a fuser; and the optimal condition under which the image forming apparatus performs a fusing process is the target fuser temperature.

[14] The replacement toner cartridge management system as recited in the aforementioned item [13], wherein if the number of times the productivity is deceased by reducing the power input to the fuser, having been counted for a certain period of time is equal to or larger than a predetermined value, the determiner of the management apparatus determines that a replacement toner cartridge filled with the toner requiring a lower fuser temperature should be delivered; or if it is smaller than the predetermined value, the determiner of the management apparatus determines that a replacement toner cartridge filled with the toner requiring a higher fuser temperature should be delivered.

[15] The replacement toner cartridge management system as recited in the aforementioned item [12], wherein if multiple colors and types of toner are contained in toner cartridges, the image forming apparatus adjusts the fuser temperature for each page based on the ratio of the types of toner and the amounts of the respective colors of toner used for image forming.

[16] The replacement toner cartridge management system as recited in the aforementioned item [12], wherein the output portion of the image forming apparatus outputs the delivery instruction to an order receiving server which the image forming apparatus can access via a communication circuit to place an order for a consumable unit.

[17] A replacement toner cartridge management method for a replacement toner cartridge management system provided with one or more than one image forming apparatus and a management apparatus which can access each other via a communication circuit, including:

the image forming apparatus's:

transmitting first information indicating a new toner cartridge having just been loaded thereon or a toner cartridge to be replaced with a new one and second information indicating the current condition under which a fusing process is performed for image forming;

the management apparatus's:

obtaining the first information and the second information;

determining the right type of a replacement toner cartridge to be loaded in place of the toner cartridge causing the obtained first information, based on the obtained second information;

outputting an instruction to deliver a replacement toner cartridge of the determined type; and transmitting information indicating that delivery has been arranged, to the image forming apparatus; and the image forming apparatus's:

detecting a new toner cartridge having just been loaded thereon;

identifying the type of a replacement toner cartridge delivered, from the information obtained from the management apparatus; and performing a fusing process under the optimal condition based on the amount of the toner supplied from the detected new toner cartridge which is a replacement toner cartridge delivered according to the delivery instruction.

[18] A non-transitory computer-readable recording medium having a fuser control program stored thereon to make a computer of an image forming apparatus execute:

obtaining first information indicating a new toner cartridge having just been loaded on the image forming apparatus or a toner cartridge to be replaced with a new one and second information indicating the current condition under which a fusing process is performed for image forming;

determining the right type of a replacement toner cartridge to be loaded in place of the toner cartridge causing the obtained first information, based on the obtained second information;

outputting an instruction to deliver a replacement toner cartridge of the determined type;

detecting a new toner cartridge having just been loaded thereon; and performing a fusing process under the optimal condition based on the amount of the toner supplied from the detected new toner cartridge which is a replacement toner cartridge delivered according to the delivery instruction.

A non-transitory computer-readable recording medium having a replacement toner cartridge management program stored thereon to make a computer of a management apparatus execute:

obtaining from one or more than one image forming apparatus which the management apparatus can access via a communication circuit, first information indicating a new toner cartridge having just been loaded on the image forming apparatus or a toner cartridge to be replaced with a new one and second information indicating the current condition under which a fusing process is performed for image forming;

determining the right type of a replacement toner cartridge to be loaded in place of the toner cartridge causing the obtained first information, based on the obtained second information;

outputting an instruction to deliver a replacement toner cartridge of the determined type; and transmitting information indicating that delivery has been arranged, so that the image forming apparatus can perform a fusing process under the optimal condition based on the amount of the toner supplied from a replacement toner cartridge delivered according to the delivery instruction.

According to the mode as recited in the aforementioned item [1], if the first information indicating a new toner cartridge or a toner cartridge to be replaced with a new one, the right type of a replacement toner cartridge to be loaded in place of the toner cartridge causing the first information is determined based on the second information indicating the current condition under which a fusing process is performed for image forming, and an instruction to deliver a replacement toner cartridge of the determined type is outputted. And then, after a detector detecting a new toner cartridge detects a new toner cartridge which is a replacement toner cartridge delivered according to the delivery instruction, a fusing process is performed under the optimal condition based on the amount of the toner supplied from the replacement toner cartridge.

Briefly, according to this mode, an instruction to deliver a replacement toner cartridge of the best type for the current condition under which a fusing process is performed for image forming is outputted, and after the replacement toner cartridge is loaded as a new one, a fusing process is performed under the optimal condition based on the amount of the toner supplied from the replacement toner cartridge. In this way, the costs of toner cartridges can be saved as much as possible.

According to the mode as recited in the aforementioned item [2], a replacement toner cartridge which is filled with the toner requiring the optimal fuser temperature based on the power input to a fuser is delivered, and if different types of toner are mixed in a development unit after the replacement toner cartridge is loaded as a new one, a fusing process is performed under the optimal fuser temperature based on the amount of the toner supplied from the replacement toner cartridge. In this way, even if there are different types of toner, the optimal fuser temperature for the mixed toner always can be obtained.

According to the mode as recited in the aforementioned item [3], if the number of times the productivity is deceased by reducing the power input to the fuser, having been counted for a certain period of time is equal to or larger than a predetermined value, a replacement toner cartridge filled with the toner requiring a lower fuser temperature will be delivered; or if it is smaller than the predetermined value, a replacement toner cartridge filled with the toner requiring a higher fuser temperature will be delivered. In this way, the better type of toner based on the characteristics caused by power control can be selected for image forming.

According to the mode as recited in the aforementioned item [4], if there are multiple toner cartridges filled with the toner requiring different optimal fuser temperatures, the image forming apparatus is allowed to use toner cartridges filled with toner of the better type based on the characteristics caused by power control.

According to the mode as recited in the aforementioned item [5], the type of a replacement toner cartridge delivered according to the delivery instruction is identified from the information indicating the determined type of replacement toner cartridge, and a fusing process is performed suitably for the identified type. Since the toner cartridges do not have to store thereon information to identify the types of the toner contained, the costs of toner cartridges can be saved.

According to the mode as recited in the aforementioned item [6], the delivery instruction is outputted to an order receiving server, thereby an order for a replacement toner cartridge of the determined type is placed automatically.

According to the mode as recited in the aforementioned item [7], the management apparatus outputs an instruction to deliver a replacement toner cartridge of the best type for the current condition under which the image forming apparatus performs a fusing process for image forming, and after the replacement toner cartridge is loaded on the image forming apparatus as a new one, the image forming apparatus performs a fusing process under the optimal condition based on the amount of the toner supplied from the replacement toner cartridge. And then, receiving the information indicating the determined type of replacement toner cartridge from the management apparatus, the image forming apparatus identifies the type of a replacement toner cartridge delivered according to the delivery instruction, and performs a fusing process accordingly. Since the toner cartridges do not need to hold information to identify the types of the toner contained, the costs of toner cartridges can be saved.

According to the mode as recited in the aforementioned item [8], the management apparatus outputs an instruction to deliver a replacement toner cartridge which is filled with the toner requiring the optimal fuser temperature based on the power input to a fuser, and then if different types of toner are mixed in a development unit after the replacement toner cartridge is loaded on the image forming apparatus as a new one, the image forming apparatus performs a fusing process under the optimal fuser temperature based on the amount of the toner supplied from the replacement toner cartridge.

According to the mode as recited in the aforementioned item [9], if the number of times the productivity is deceased by reducing the power input to the fuser, having been counted for a certain period of time is equal to or larger than a predetermined value, the management apparatus outputs an instruction to deliver a replacement toner cartridge filled with the toner requiring a lower fuser temperature; or if it is smaller than the predetermined value, the management apparatus outputs an instruction to deliver a replacement toner cartridge filled with the toner requiring a higher fuser temperature. According the mode as recited in the aforementioned item [10], if there are multiple toner cartridges filled with the toner requiring different optimal fuser temperatures, the image forming apparatus is allowed to use toner cartridges filled with toner of the better type based on the characteristics caused by power control.

According to the mode as recited in the aforementioned item [11], by outputting the delivery instruction to an order receiving server, the management apparatus automatically places an order for a replacement toner cartridge of the determined type.

According to the mode as recited in the aforementioned item [12], the management system outputs an instruction to deliver a replacement toner cartridge of the best type for the current condition under which the image forming apparatus performs a fusing process for image forming, and after the replacement toner cartridge is loaded on the image forming apparatus as a new one, the image forming apparatus performs a fusing process under the optimal condition based on the amount of the toner supplied from the replacement toner cartridge. And then, receiving the information indicating the determined type of replacement toner cartridge from the management apparatus, the image forming apparatus identifies the type of a replacement toner cartridge delivered according to the delivery instruction, and performs a fusing process accordingly. Since the toner cartridges do not need to hold information to identify the types of the toner contained, the costs of toner cartridges can be saved.

According to the mode as recited in the aforementioned item [13], the management apparatus outputs an instruction to deliver a replacement toner cartridge which is filled with the toner requiring the optimal fuser temperature based on the power input to a fuser, and then if different types of toner are mixed in a development unit after the replacement toner cartridge is loaded on the image forming apparatus as a new one, the image forming apparatus performs a fusing process under the optimal fuser temperature based on the amount of the toner supplied from the replacement toner cartridge.

According to the mode as recited in the aforementioned item [14], if the number of times the productivity is deceased by reducing the power input to the fuser, having been counted for a certain period of time is equal to or larger than a predetermined value, the management system delivers a replacement toner cartridge filled with the toner requiring a lower fuser temperature; or if it is smaller than the predetermined value, the management system delivers a replacement toner cartridge filled with the toner requiring a higher fuser temperature.

According the mode as recited in the aforementioned item [15], if there are multiple toner cartridges filled with the toner requiring different optimal fuser temperatures, the image forming apparatus is allowed to use toner cartridges filled with toner of the better type based on the characteristics caused by power control.

According to the mode as recited in the aforementioned item [16], the delivery instruction is outputted to an order receiving server, thereby an order for a replacement toner cartridge of the determined type is placed automatically.

According to the mode as recited in the aforementioned item [17], the management apparatus outputs an instruction to deliver a replacement toner cartridge of the best type for the current condition under which the image forming apparatus performs a fusing process for image forming, and after the replacement toner cartridge is loaded on the image forming apparatus as a new one, the image forming apparatus performs a fusing process under the optimal condition based on the amount of the toner supplied from the replacement toner cartridge. And then, receiving the information indicating the determined type of replacement toner cartridge from the management apparatus, the image forming apparatus identifies the type of a replacement toner cartridge delivered according to the delivery instruction, and performs a fusing process accordingly. Since the toner cartridges do not need to hold information to identify the types of the toner contained, the costs of toner cartridges can be saved.

According to the mode as recited in the aforementioned item [18], a computer of the image forming apparatus executes outputting an instruction to deliver a replacement toner cartridge of the best type for the current condition under which a fusing process is performed for image forming; and performing a fusing process under the optimal condition based on the amount of the toner supplied from the replacement toner cartridge after the replacement toner cartridge is loaded on the image forming apparatus as a new one.

According to the mode as recited in the aforementioned item [19], a computer of the management apparatus is allowed to execute outputting an instruction to deliver a replacement toner cartridge of the best type for the current condition under which the image forming apparatus performs a fusing process for image forming; and transmitting the information indicating the determined type of replacement toner cartridge to the image forming apparatus, so that the image forming apparatus can perform a fusing process under the optimal condition based on the amount of the toner supplied from the replacement toner cartridge after the replacement toner cartridge is loaded on the image forming apparatus as a new one.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An image forming apparatus being characterized by having:

an obtainer to obtain: first information indicating that a toner cartridge has been replaced or a toner cartridge needs to be replaced; and second information indicating a log of fusing conditions for the image forming apparatus to perform image forming;

a determiner to determine the type of a replacement toner cartridge to be loaded in place of the toner cartridge causing the first information, on the basis of the second information, when the first information is received by the obtainer;

an output portion to output an instruction to deliver a replacement toner cartridge of the type determined by the determiner;

a detector to detect that a toner cartridge has been replaced; and a fuser to perform a fusing process under one of the fusing conditions, the one being optimal for the amount of toner supplied, after the detector detects that the toner cartridge has been replaced with the replacement toner cartridge delivered in accordance with the delivery instruction.

2. The image forming apparatus as recited in claim 1, wherein: a replacement toner cartridge of the type determined by the determiner is filled with toner requiring a different optimal fusing temperature;

the fusing conditions indicated by the second information is the power input to a fuser; and the optimal fusing condition under which the fusing process is performed by the image forming apparatus is the target fusing temperature.

3. The image forming apparatus as recited in claim 2, wherein: the determiner determines that a replacement toner cartridge filled with toner requiring a relatively low fusing temperature should be delivered, if the frequency that the productivity falls with reduction of the power input to the fuser, the frequency being measured for a certain period of time, is greater than a predetermined value; and the determiner determines that a replacement toner cartridge filled with toner requiring a relatively high fusing temperature should be delivered, if the same is less than the predetermined value.

4. The image forming apparatus as recited in claim 1, wherein if multiple colors and types of toner are used, the fuser adjusts the fusing temperature for each page on the basis of the ratio of the types of toner and the amount of toner of each color consumed for image forming.

5. The image forming apparatus as recited in claim 1, further comprising a receiver to externally receive information indicating that the replacement toner cartridge has been delivered, wherein the fuser identifies the type of the replacement toner cartridge delivered in accordance with the delivery instruction, on the basis of the information received by the receiver.

6. The image forming apparatus as recited in claim 1, wherein the output portion outputs the delivery instruction to an order receiving server to receive an order for a consumable unit, the order receiving server being connected to the image forming apparatus via a line of communication.

7. A replacement toner cartridge management apparatus being characterized by having:

a receiver to receive from at least one image forming apparatus which can be accessed by the replacement toner cartridge management apparatus: first information indicating that a toner cartridge has been replaced or a toner cartridge needs to be replaced; and second information indicating a log of fusing conditions for the at least one image forming apparatus to perform image forming;

a determiner to determine the type of a replacement toner cartridge to be loaded in place of the toner cartridge causing the first information, on the basis of the second information, when the first information is received by the receiver;

an output portion to output an instruction to deliver a replacement toner cartridge of the type determined by the determiner; and a notifier to notify the at least one image forming apparatus of the type determined by the determiner, such that the at least one image forming apparatus can perform a fusing process under one of the fusing conditions, the one being optimal for the amount of toner supplied, after the toner cartridge is replaced with the replacement toner cartridge delivered in accordance with the delivery instruction.

8. The replacement toner cartridge management apparatus as recited in claim 7, wherein: a replacement toner cartridge of the type determined by the determiner is filled with toner requiring a different optimal fusing temperature;

the fusing conditions indicated by the second information is the power input to a fuser; and the optimal fusing condition under which the at least one image forming apparatus performs a fusing process is the target fusing temperature.

9. The replacement toner cartridge management apparatus as recited in claim 8, wherein: the determiner determines that a replacement toner cartridge filled with toner requiring a relatively low fusing temperature should be delivered, if the frequency that the productivity falls with reduction of the power input to the fuser, the frequency being measured for a certain period of time, is greater than a predetermined value; and the determiner determines that a replacement toner cartridge filled with toner requiring a relatively high fusing temperature should be delivered, if the same is less than the predetermined value.

10. The replacement toner cartridge management apparatus as recited in claim 7, wherein if multiple colors and types of toner are used, the at least one image forming apparatus adjusts the fusing temperature for each page on the basis of the ratio of the types of toner and the amount of toner of each color consumed for image forming.

11. The replacement toner cartridge management apparatus as recited in claim 7, wherein the output portion outputs the delivery instruction to an order receiving server to receive an order for a consumable unit, the order receiving server being connected to the at least one image forming apparatus via a line of communication.

12. A replacement toner cartridge management system being characterized by having a management apparatus and at least one image forming apparatus which can be accessed by each other via a line of communication, the at least one image forming apparatus comprising a transmitter to transmit: first information indicating that a toner cartridge has been replaced or a toner cartridge needs to be replaced; and second information indicating a log of fusing conditions for the at least one image forming apparatus to perform image forming, the management apparatus comprising:

a receiver to receive the first information and the second information;

a determiner to determine the type of a replacement toner cartridge to be loaded in place of the toner cartridge causing the first information, on the basis of the second information, when the first information is received;

an output portion to output an instruction to deliver a replacement toner cartridge of the type determined by the determiner; and a notifier to notify the at least one image forming apparatus of the type determined by the determiner, the at least one image forming apparatus further comprising:

a detector to detect that a toner cartridge has been replaced;

an identifier to identify the type of the replacement toner cartridge delivered, on the basis of the notification of the notifier; and a fuser to perform a fusing process under one of the fusing conditions, the one being optimal for the amount of toner supplied, after the detector detects that the toner cartridge has been replaced with the replacement toner cartridge delivered in accordance with the delivery instruction, the replacement toner cartridge whose type is identified by the identifier.

13. The replacement toner cartridge management system as recited in claim 12, wherein:

a replacement toner cartridge of the type determined by the determiner is filled with toner requiring a different optimal fusing temperature;

the fusing conditions indicated by the second information is the power input to a fuser; and the optimal fusing condition under which the at least one image forming apparatus performs a fusing process is the target fusing temperature.

14. The replacement toner cartridge management system as recited in claim 13, wherein:

the determiner of the management apparatus determines that a replacement toner cartridge filled with toner requiring a relatively low fusing temperature should be delivered, if the frequency that the productivity falls with reduction of the power input to the fuser, the frequency being measured for a certain period of time, is greater than a predetermined value; and the determiner of the management apparatus determines that a replacement toner cartridge filled with toner requiring a relatively high fusing temperature should be delivered, if the same is less than the predetermined value.

15. The replacement toner cartridge management system as recited in claim 12, wherein if multiple colors and types of toner are used, the fuser of the at least one image forming apparatus adjusts the fusing temperature for each page on the basis of the ratio of the types of toner and the amount of toner of each color consumed for image forming.

16. The replacement toner cartridge management system as recited in claim 12, wherein the output portion of the at least one image forming apparatus outputs the delivery instruction to an order receiving server to receive an order for a consumable unit, the order receiving server being connected to the at least one image forming apparatus via a line of communication.

17. A replacement toner cartridge management method being implemented by a replacement toner cartridge management system comprising a management apparatus and at least one image forming apparatus which can be accessed by each other via a line of communication, the replacement toner cartridge management method being characterized by having:

the following step of the at least one image forming apparatus: transmitting: first information indicating that a toner cartridge has been replaced or a toner cartridge needs to be replaced; and second information indicating a log of fusing conditions for the at least one image forming apparatus to perform image forming;

the following steps of the management apparatus:

receiving the first information and the second information;

determining the type of a replacement toner cartridge to be loaded in place of the toner cartridge causing the first information, on the basis of the second information, when receiving the first information;

outputting an instruction to deliver a replacement toner cartridge of the type determined in the determination step; and notifying the at least one image forming apparatus of the type determined in the determination step; and the following steps of the at least one image forming apparatus:

detecting that a toner cartridge has been replaced;

identifying the type of the replacement toner cartridge delivered, on the basis of the notification in the notification step; and performing a fusing process under one of the fusing conditions, the one being optimal for the amount of toner supplied, after detecting in the detection step that the toner cartridge has been replaced with the replacement toner cartridge delivered in accordance with the delivery instruction, the replacement toner cartridge whose type is identified in the identification step.

18. A non-transitory computer readable recording medium having a fuser control program stored thereon to make a computer of an image forming apparatus execute:

obtaining: first information indicating that a toner cartridge has been replaced or a toner cartridge needs to be replaced; and second information indicating a log of fusing conditions for the image forming apparatus to perform image forming;

determining the type of a replacement toner cartridge to be loaded in place of the toner cartridge causing the first information, on the basis of the second information, when obtaining the first information in the obtaining step;

outputting an instruction to deliver a replacement toner cartridge of the type determined in the determination step;

detecting that a toner cartridge has been replaced; and performing a fusing process under one of the fusing conditions, the one being optimal for the amount of toner supplied, after detecting in the detection step that the toner cartridge has been replaced with the replacement toner cartridge delivered in accordance with the delivery instruction.

19. A non-transitory computer-readable recording medium having a replacement toner cartridge management program stored thereon to make a computer of a management apparatus execute:

receiving from at least one image forming apparatus which can be accessed by the replacement toner cartridge management apparatus: first information indicating that a toner cartridge has been replaced or a toner cartridge needs to be replaced; and second information indicating a log of fusing conditions for the at least one image forming apparatus to perform image forming;

determining the type of a replacement toner cartridge to be loaded in place of the toner cartridge causing the first information, on the basis of the second information, when receiving the first information in the receiving step;

outputting an instruction to deliver a replacement toner cartridge of the type determined in the determination step; and notifying the at least one image forming apparatus of the type determined in the determination step, such that the at least one image forming apparatus can perform a fusing process under one of the fusing conditions, the one being optimal for the amount of toner supplied, after the toner cartridge is replaced with the replacement toner cartridge delivered in accordance with the delivery instruction.

* * * * *